US009399361B2

(12) United States Patent
Yuno

(10) Patent No.: US 9,399,361 B2
(45) Date of Patent: Jul. 26, 2016

(54) STAMP FACE FORMING APPARATUS, STAMP FACE FORMING METHOD, AND MEDIUM

(71) Applicant: CASIO COMPUTER CO., LTD., Shibuya-ku, Tokyo (JP)

(72) Inventor: Hirotaka Yuno, Hiratsuka (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/533,972

(22) Filed: Nov. 5, 2014

(65) Prior Publication Data

US 2015/0122140 A1 May 7, 2015

(30) Foreign Application Priority Data

Nov. 5, 2013 (JP) ..... 2013-229261
Jun. 27, 2014 (JP) ..... 2014-132827

(51) Int. Cl.
*B41J 2/32* (2006.01)
*B41K 1/50* (2006.01)
*B41C 1/055* (2006.01)
(Continued)

(52) U.S. Cl.
CPC ... *B41K 1/50* (2013.01); *B41C 1/05* (2013.01); *B41C 1/055* (2013.01); *B41J 2/32* (2013.01); *B41K 1/04* (2013.01)

(58) Field of Classification Search
CPC ..... B41K 1/50; B41K 1/02; B41C 1/05; B41C 1/055; B41J 2/32
USPC ..... 101/333, 401.1; 347/171; 400/120.01
See application file for complete search history.

(56) References Cited

U.S. PATENT DOCUMENTS 4,870,428 A * 9/1989 Kuwabara ..... B41J 2/355 347/179
4,955,736 A * 9/1990 Iwata ..... B41J 2/38 347/179

(Continued)

FOREIGN PATENT DOCUMENTS

JP 05336324 A 12/1993
JP 07081124 A 3/1995

(Continued)

OTHER PUBLICATIONS

Japanese Office Action (and English translation thereof) dated Sep. 8, 2015, issued in counterpart Japanese Application No. 2014-132827.

(Continued)

*Primary Examiner* — Leslie J Evanisko
(74) *Attorney, Agent, or Firm* — Holtz, Holtz & Volek PC

(57) ABSTRACT

A stamp face forming apparatus includes a stamp face forming part including a plurality of heating elements arranged in a direction along a surface holding a porous stamp face material that can be made non-porous by heating, and a drive circuit for controlling heat generating states of the plurality of heating elements to form a stamp face on the stamp face material; and a controller for controlling the drive circuit of the stamp face forming part by adjusting a signal to be applied to the drive circuit such that an amount of heat per dot for a dot to be heated directly adjacent to a dot to be non-heated is less than an amount of heat per dot for a dot to be heated not directly adjacent to the dot to be non-heated in image data for forming the stamp face.

22 Claims, 14 Drawing Sheets

(51) Int. Cl.
*B41C 1/05* (2006.01)
*B41K 1/04* (2006.01)

(56) References Cited

U.S. PATENT DOCUMENTS

| | | | | | |
|---|---|---|---|---|---|
| 5,741,459 | A | * | 4/1998 | Ando | B29C 44/5636 101/333 |
| 6,045,275 | A | * | 4/2000 | Hosoya | B41J 2/375 400/120.01 |
| 6,163,329 | A | * | 12/2000 | Venkataraman | B41C 1/055 101/327 |
| 2004/0003735 | A1 | * | 1/2004 | Humal | B41D 7/00 101/401.1 |

FOREIGN PATENT DOCUMENTS

| | | | |
|---|---|---|---|
| JP | 08174894 | A | 7/1996 |
| JP | 09314883 | A | 12/1997 |
| JP | 10100464 | A | 4/1998 |
| JP | 2002137354 | A | 5/2002 |
| JP | 2009208294 | A | 9/2009 |
| JP | 2011016256 | A | 1/2011 |

OTHER PUBLICATIONS

Japanese Office Action (and English translation thereof) dated May 10, 2016, issued in Japanese Application No. 2014-132827.

* cited by examiner

DETAIL OF PART IIA

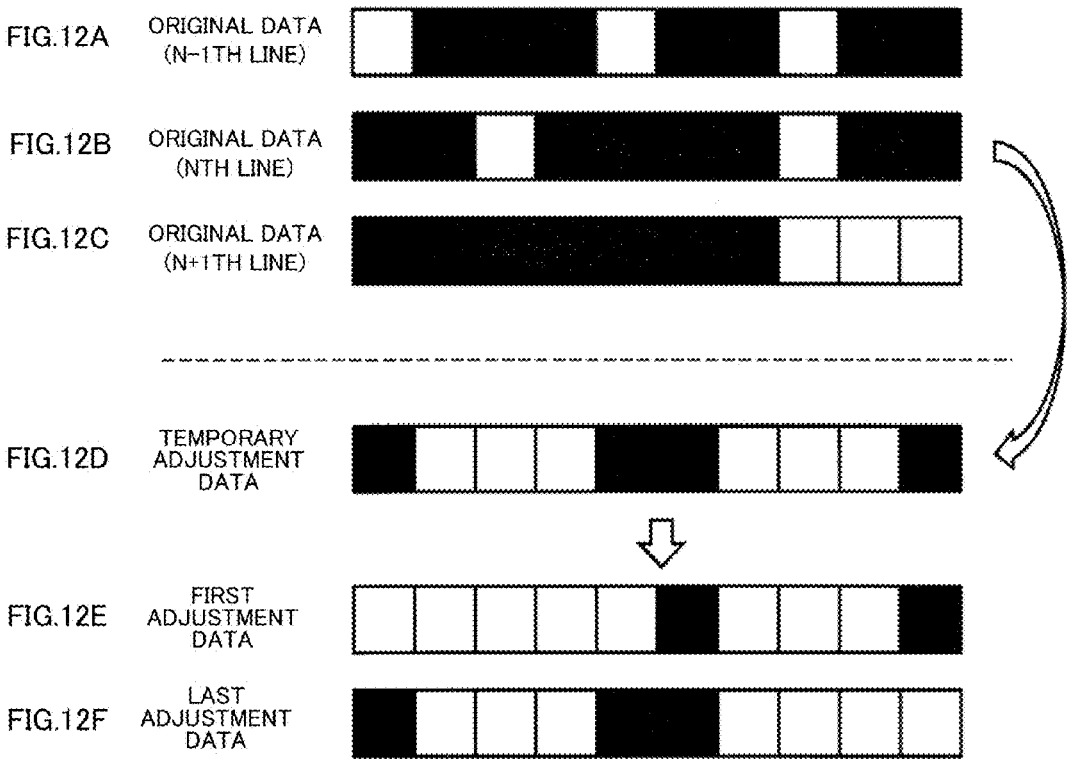
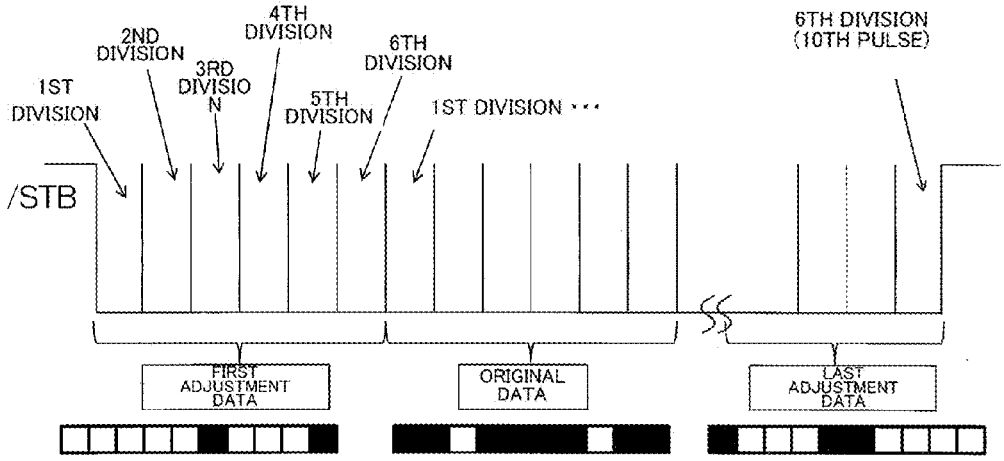
FIG. 13

* C(m,n) OPERATION IS OMITTED FOR SIMPLIFICATION.

STAMP FACE FORMING APPARATUS, STAMP FACE FORMING METHOD, AND MEDIUM

CROSS-REFERENCE TO RELATED APPLICATION

This application is based upon and claims the benefit of priority from the prior Japanese Patent Applications No. 2013-229261, filed on Nov. 5, 2013, and No. 2014-132827, filed on Jun. 27, 2014, the entire contents of which are incorporated herein by reference.

FIELD

This application relates to a stamp face forming apparatus for forming a stamp face on a stamp face material held by a stamp face material holder, a stamp face forming method, and a medium.

BACKGROUND

In order to save the trouble of applying ink on a stamp face at each stamping, there is conventionally known a stamp whose stamp face material is a porous sheet of sponge rubber or the like impregnated with ink in advance. For example, Unexamined Japanese Patent Application Kokai Publication No. H10-100464 proposes an apparatus that performs platemaking of a stamp face consisting of a melting/solidification portion inhibiting the permeation of ink and a non-melting portion allowing the permeation of ink on a stamp face plate (a stamp face material) by fixing a stamp with the stamp face plate made of a porous sheet attached to a wooden base on the platemaking apparatus, pressing a thermal head on a surface of the porous sheet and moving the head, and selectively applying heat to heating elements of the thermal head.

There is also a thermal transfer printer that performs printing as follows: an ink film formed by applying a thermally melted ink on a film is arranged on a record sheet and then heat is applied to heating elements of a thermal head in close contact with a surface of the ink film having no ink applied thereon, thereby causing the ink on the ink film to be melt-transferred on the record sheet. In such a thermal transfer printer, any isolated dot included in image data to be printed can be collapsed and cannot be printed. Thus, for preventing the collapse, Unexamined Japanese Patent Application Kokai Publication No. H07-081124 proposes a method for controlling to supplementarily apply heat also to a peripheral region to be non-heated.

Suppression of dot collapse described as a problem to be solved in Unexamined Japanese Patent Application Kokai Publication No. H07-081124 is the same problem to be solved by the stamp face platemaking apparatus proposed in Unexamined Japanese Patent Application Kokai Publication No. H10-100464.

Meanwhile, regarding the amount of heat to be supplementarily applied, Unexamined Japanese Patent Application Kokai Publication No. H07-081124 only mentions a total amount of heat and does not provide any more details.

SUMMARY

According to a first aspect of the present invention, there is provided a stamp face forming apparatus that includes a stamp face forming part including a plurality of heating elements arranged in a direction along a surface holding a porous stamp face material that can be made non-porous by heating, and a drive circuit for controlling heat generating states of the plurality of heating elements to form a stamp face on the stamp face material; and a controller for controlling the drive circuit of the stamp face forming part by adjusting a signal to be applied to the drive circuit such that an amount of heat per dot for a dot to be heated directly adjacent to a dot to be non-heated is less than an amount of heat per dot for a dot to be heated not directly adjacent to the dot to be non-heated in image data for forming the stamp face.

In addition, according to a second aspect of the present invention, there is provided a stamp face forming method including a step of controlling a drive circuit of a stamp face forming part for forming a stamp face by applying heat to a porous stamp face material, that can be made non-porous by heating using a plurality of heating elements arranged in a direction along a surface holding the stamp face material and the drive circuit for controlling heat generating states of the plurality of heating elements, by adjusting a signal to be applied to the drive circuit such that an amount of heat per dot for a dot to be heated directly adjacent to a dot to be non-heated is less than an amount of heat per dot for a dot to be heated not directly adjacent to the dot to be non-heated, when forming the stamp face on the stamp face material while relatively moving the stamp face material with respect to the stamp face forming part.

In addition, according to a third aspect of the present invention, there is provided a non-transitory computer readable recording medium including computer-executable instructions for causing a computer comprising one or more processors and/or memories to control a drive circuit of a stamp face forming part for forming a stamp face by applying heat to a porous stamp face material, that can be made non-porous by heating using a plurality of heating elements arranged in a direction along a surface holding the stamp face material and the drive circuit for controlling heat generating states of the plurality of heating elements, by adjusting a signal to be applied to the drive circuit such that an amount of heat per dot for a dot to be heated directly adjacent to a dot to be non-heated is less than an amount of heat per dot for a dot to be heated not directly adjacent to the dot to be non-heated, when forming the stamp face on the stamp face material while relatively moving the stamp face material with respect to the stamp face forming part.

Additional objects and advantages of embodiments of the invention will be set forth in the description which follows, and in part will be obvious from the description, or may be learned by practice of the embodiments. The objects and advantages of the embodiments may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIGS. 12A to 12F are diagrams showing adjustment data creating method in the first embodiment;

FIG. 13 is a schematic diagram of an electric signal;

DETAILED DESCRIPTION OF THE INVENTION

Definitions of Concepts and Terms

Figure 1A:
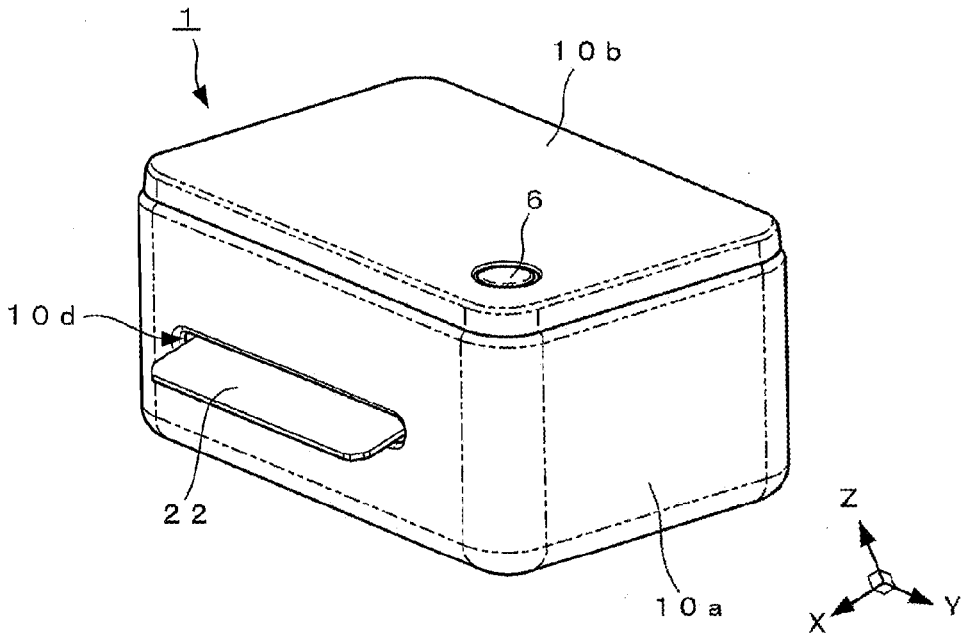
FIG. 1A is an external perspective view of a stamp face forming apparatus according to a first embodiment of the present disclosure and a stamp face material holder.

Definitions of important concepts and terms will be given below before the description of embodiments of the present invention.

Stamp face forming apparatus is defined as an apparatus that forms a stamp face by forming a pattern on a stamp face material. In the present embodiment, a so-called thermal printer can be used as the apparatus. The thermal printer includes a thermal head including a plurality of heating elements and a drive circuit (driver) for driving the plurality of heating elements, and each of the heating elements can be selectively heated by the drive circuit.

The stamp face material includes a porous sponge body that can be impregnated with liquid ink and is a thermoplastic member that is to be made non-porous by heating. An example of the stamp face material usable is a porous ethylene vinyl acetate (EVA) copolymer.

The stamp face material holder is a tool for inserting through the stamp face forming apparatus in order to form a pattern on the stamp face material. For example, the stamp face material holder holding the stamp face material is supplied to a user of the stamp face forming apparatus. For convenience, the present specification defines the stamp face material holder as one that includes the stamp face material and a holding body for holding the stamp face material.

The holding body includes, for example, a paper board including a coated cardboard. After the formation of a stamp face, the stamp face material is taken out from the stamp face material holder, and then the holding body is discarded.

The stamp face forming part is a mechanism that causes the thermal head to selectively apply heat to make a part of a surface of the stamp face material non-porous so as to inhibit ink from passing through the part.

Printing does not mean printing using ink but means to perform processing in which according to image data, the heating elements of the thermal head are selectively heated and thereby the surface of the stamp face material is made non-porous or not per dot corresponding to a predetermined size, that is, a size of each heating element of the thermal head.

Electric signal is defined as a signal to be applied to the drive circuit of the thermal head, and is a signal for applying electric power that causes the thermal head to generate heat.

A dot to be non-heated refers to one that is not to be heated among the plurality of heating elements of the thermal head. When seen from an image of a stamp face to be formed, a dot to be non-heated corresponds to a portion that allows ink to pass therethrough.

A dot to be heated refers to that to be heated among the plurality of heating elements of the thermal head. When seen from the image of the stamp face to be formed, a dot to be heated corresponds to a portion that inhibits ink from passing therethrough.

An isolated dot refers to a dot to be non-heated that has dots to be heated on both adjacent sides thereof in a main scanning direction and has dots to be heated on both adjacent sides thereof in a sub-scanning direction, that is, a single dot to be non-heated surrounded by the dots to be heated on all the four sides.

A multi-pulse system refers to a system in which an electric signal to be applied to a single heating element of the thermal head is consisted of a series of a plurality of pulses.

Print data is data for forming a stamp face desired by a user who intends to form a stamp face, on the stamp face material. Considering that printing by the thermal head is processing for inhibiting ink from passing through, print data is image data whose black and white portions and right and left sides are inverted when seen from a seal pattern left by impressing a stamp with the stamp face produced by the user.

Dot data is data representing 0 or 1 for each heating element of the thermal head.

Dot data per line refers to data containing an array of information representing 0 or 1 that is to be given to the plurality of heating elements of the thermal head in such a manner as to correspond to a direction in which the heating elements are arranged.

Calculation of "logical product" herein means to obtaining a logical product of two dot data to determine that heat is to be applied only when both of the two data represent "to be heated", whereas heat is not to be applied when one of the two data or both thereof represent "to be non-heated".

A conveyor is a mechanism for conveying the stamp face material holder and, for example, may include a platen roller and a stepping motor for driving the platen roller.

A controller refers to a controller (Central Processing Unit: CPU) of the stamp face forming apparatus. The controller of the stamp face forming apparatus is connected to a Personal Computer (PC), a smart phone, a tablet computer, or the like through a wired communication (Universal Serial Bus (USB) (registered trademark)), a wireless communication (Wireless Fidelity (Wi-Fi) (registered trademark)), Bluetooth (registered trademark), WLAN (registered trademark of Wireless Local Area Network), or the like, and can work in collaboration therewith.

Holding of the stamp face material is performed in a factory manufacturing the stamp face material holder when the stamp face material is to be supplied to users in a state in which the stamp face material is held by the stamp face material holder.

A stamp face forming step is a step performed when a user of the stamp face forming apparatus executes the formation of a stamp face by using the stamp face material holder.

It is an object of the present invention to provide a stamp face forming apparatus for forming a stamp face in a state in which a stamp face material is held by a stamp face material holder, a stamp face forming method therefor, and a medium therefor. Then, particularly in that case, the present invention focuses on how to control an amount of heat in order to suppress collapse of printing.

A detailed description will be given below of a stamp face forming apparatus according to some exemplary embodiments of the present invention, with reference to the drawings.

First Embodiment

A mechanical structure of a stamp face forming apparatus (thermal printer) will be described with reference to FIGS. 1A, 1B, 2A, 2B, 3, 4A, and 4B.

Figure 1B:
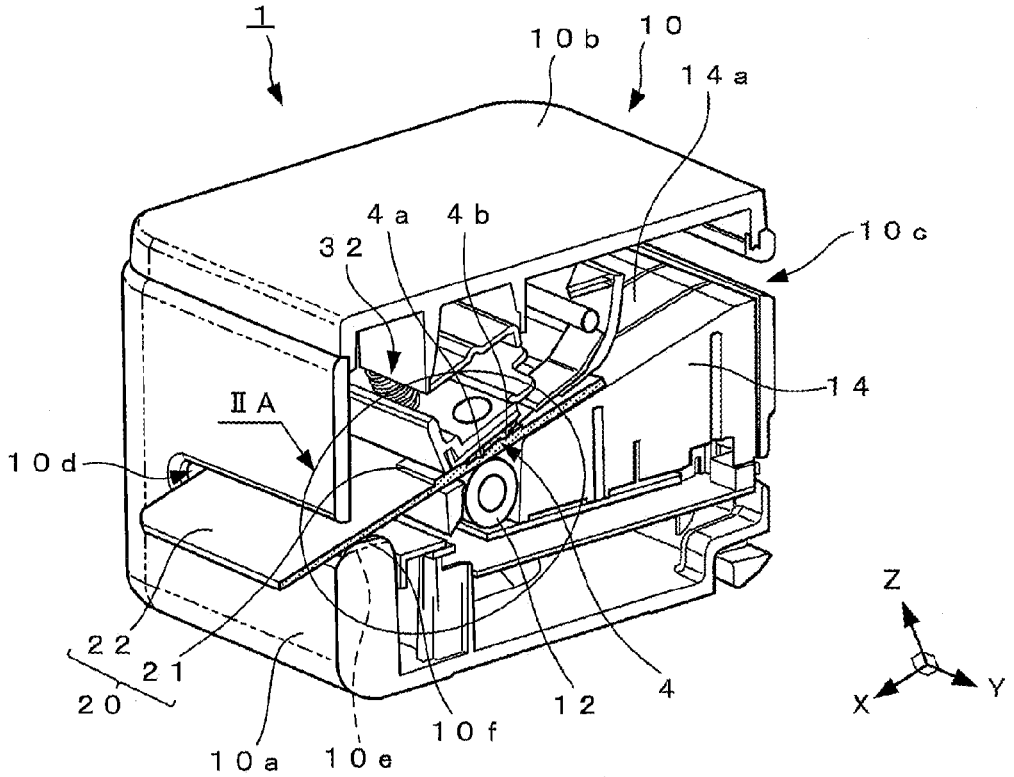
FIG. 1B is a perspective view of the stamp face forming apparatus according to the first embodiment obtained by cutting the apparatus in a vertical plane along a conveying direction for the holder.
Figure 2A:
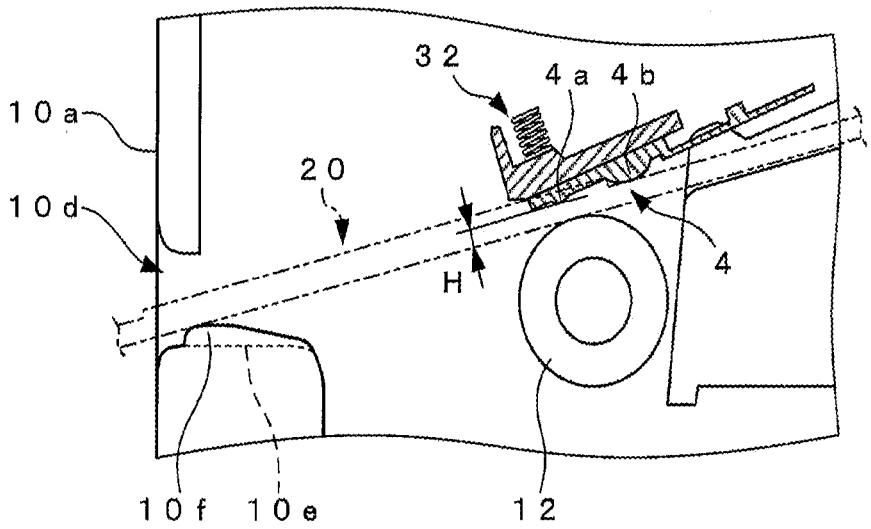
FIG. 2A is a sectional view showing a structure around an ejection port for the stamp face material holder in the stamp face forming apparatus according to the first embodiment.
Figure 2B:
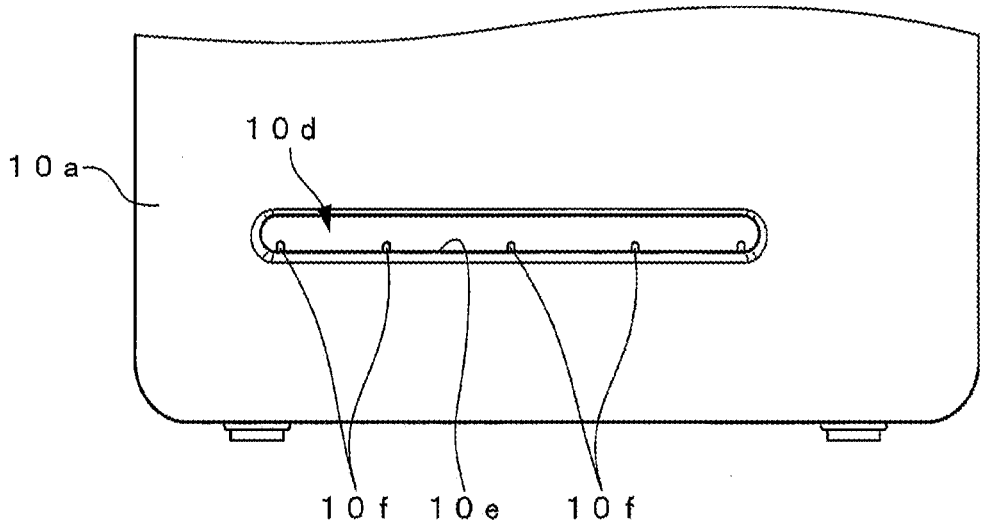
FIG. 2B is an enlarged external view of the ejection port as seen from front, in the stamp face forming apparatus according to the first embodiment.
Figure 3:
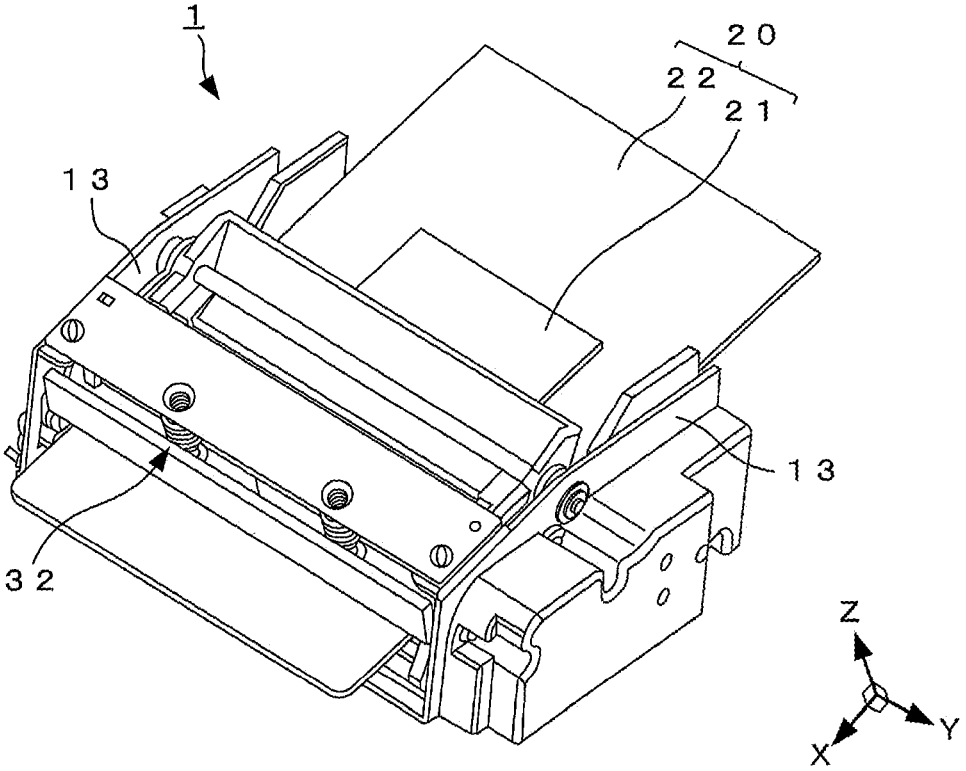
FIG. 3 is a perspective view showing a structure of a main part of a stamp face forming part applied to the stamp face forming apparatus according to the first embodiment.
Figure 4A:
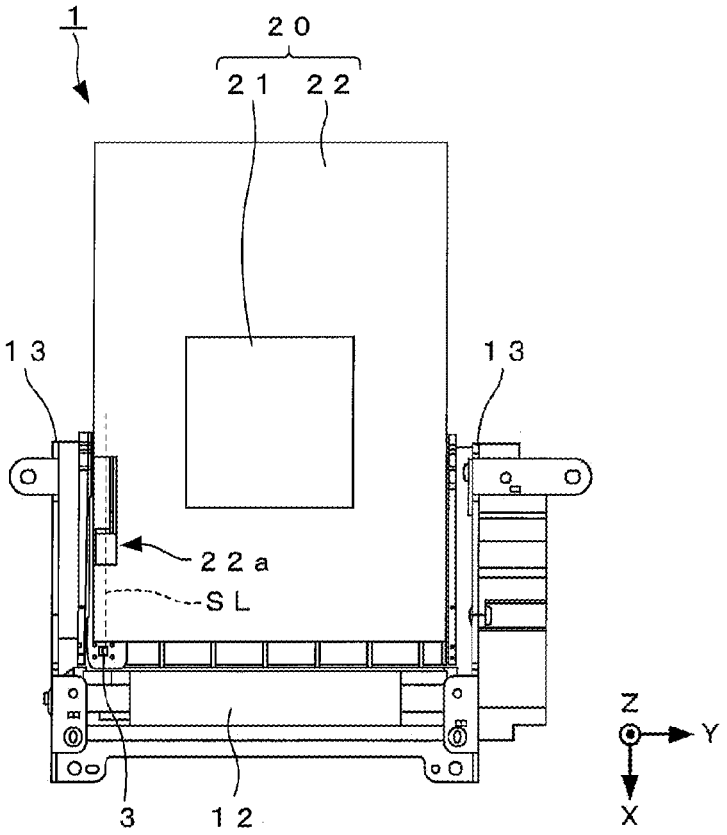
FIG. 4A is a plan view of a structure of the main part of the stamp face forming part applied to the stamp face forming apparatus of the first embodiment.
Figure 4B:
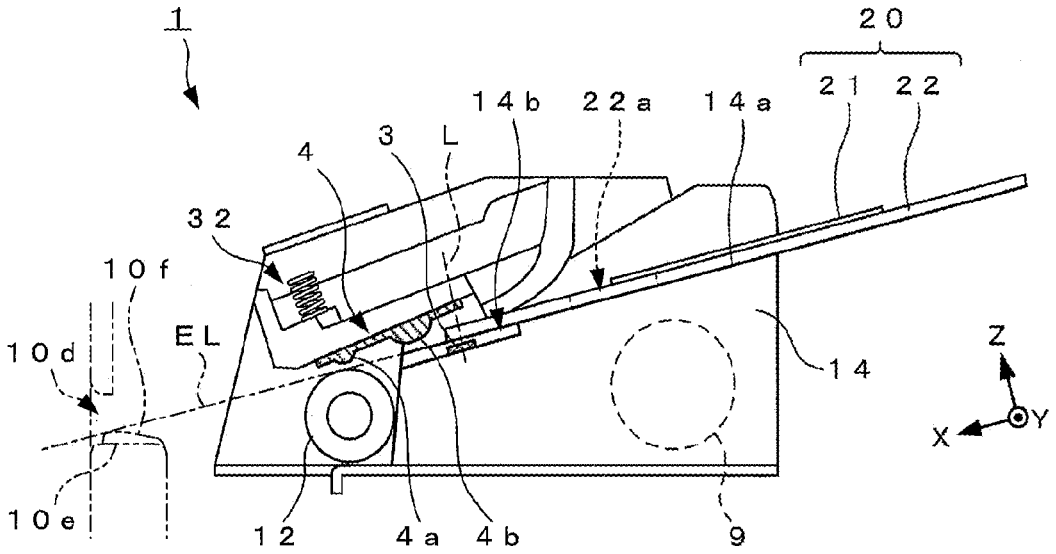
FIG. 4B is a sectional view of the stamp face forming part applied to the stamp face forming apparatus according to the first embodiment obtained by cutting the device in a vertical plane along the conveying direction for the holder.

FIG. 1A is an external perspective view showing a stamp face forming apparatus according to a first embodiment of the present invention and a stamp face material holder; and FIG. 1B is a perspective sectional view showing a sectional structure along an X-Z plane (a vertical plane including a conveying direction for the holder) of the apparatus shown in FIG. 1. FIG. 2A is a schematic diagram that shows a structure around an ejection port for the stamp face material holder in the stamp face forming apparatus according to the first embodiment, and which is a sectional view of a main part that shows a sectional structure of a part II A shown in FIG. 1B (for convenience, the present specification uses "II" as a character corresponding to the Roman numeral "2" shown in FIG. 1B and "V" as a character corresponding to the Roman numeral "5"; the same also applies hereinafter). FIG. 2B is a front view showing an external appearance of the stamp face forming apparatus including the ejection port. FIG. 3 is a perspective view showing a main part of a stamp face forming part applied to the stamp face forming apparatus according to the first embodiment. FIG. 4A is a plan view of a structure of the main part of the stamp face forming part applied to the stamp face forming apparatus according to the first embodiment, and FIG. 4B is a schematic sectional view showing a sectional structure along an X-Z plane (a vertical plane including the conveying direction for the holder) of the device shown in FIG. 4A.

A stamp face forming apparatus (hereinafter referred to as "printer") 1 according to the first embodiment is a so-called thermal printer. For example, as shown in FIGS. 1A and 1B, a stamp face material holder 20 (that includes a stamp face material 21, a holding body 22 for holding the stamp face material 21, and a film 24 for protecting the stamp face material 21, although a detail of the stamp face material 20 will be described later with reference to FIGS. 6A to 6C) is inserted from an insertion port 10*c* and conveyed to an ejection port 10*d*. Then, the printer 1 presses a thermal head 4 onto the stamp face material 21 on the stamp face material holder 20 being conveyed, under a predetermined load through the film 24, and causes a plurality of heating elements of the thermal head 4 to be selectively heated, thereby forming a stamp face (a part where there is formed a seal pattern including one or more characters, symbols, figures, and/or the like when the seal or a stamp is impressed) representing a pattern (one or more characters, symbols, figures, and/or the like) on the stamp face material 21 on the stamp face material holder 20.

As shown in FIGS. 1A and 1B, directions X, Y, and Z orthogonal to one another are set. Regarding the signs X, Y, and Z indicating the directions shown in the drawings, an arrow direction will be indicated by adding "+" to the signs, a direction opposite to the arrow direction will be indicated by adding "−" thereto, and when the direction means both directions, neither "+" nor "−" is added thereto. The direction X is the same as a direction in which the stamp face material holder 20 including the stamp face material 21 as an object for formation of a stamp face is conveyed and also referred to as front-back direction. The direction Y is the same as a width direction of the printer 1 and also referred to as right-left direction. The direction Z is the same as a direction in which the thermal head 4 is pressed onto the stamp face material holder 20 and also referred to as up-down direction.

As shown in FIGS. 1A and 1B, the printer 1 is provided with a case 10 including a lower case 10*a* and an upper case 10*b*. The insertion port 10*c* and the ejection port 10*d*, respectively, are on front and back surfaces of the lower case 10*a*. On an upper surface of the upper case 10*b* is provided an input operator 6. The input operator 6 outputs a signal corresponding to a content of an operation performed by an operating person.

In the ejection port 10*d* of the lower case 10*a*, for example, as shown in FIGS. 2A and 2B, a plurality of ribs (supporters) 10*f* formed in such a manner as to protrude with a predetermined height in the ejection port 10*d* are arranged on a lower inner surface 10*e* forming the ejection port 10*d*. The plurality of ribs 10*f* are arranged at a predetermined interval in a direction of an opening of the ejection port 10*d* (the direction Y). Herein, the plurality of ribs 10*f* are located on a conveyance path for conveying the stamp face material holder 20 ejected from the ejection port 10*d*. In other words, the plurality of ribs 10*f* are provided to come in contact with a back surface side near one end side (a direction +X side) of the stamp face material holder 20 (a surface opposite to a stamp face-formed surface of the material onto which the thermal head 4 is pressed, that is, a lower side of FIG. 2A) so as to support the holder at a point in time when the stamp face material holder 20 inserted from the insertion port 10*c* is conveyed through the inside of the printer 1 and then at least the state in which the thermal head 4 has been pressed on the stamp face material holder 20 is changed to a specific state. At this time, the plurality of ribs 10*f* are provided in such a manner as to come in contact with the back surface of the stamp face material holder 20 at such an extent that the stamp face material holder 20 is not bent (deformed). More preferably, the plurality of ribs 10*f* are provided so as to support the stamp face material holder 20 at such an extent as not to affect the conveyance (an amount of conveyance) of the stamp face material holder 20, for example, at such an extent that the ribs 10*f* contact lightly therewith in a less frictional state.

A stamp face forming system incorporated in the case 10 of the printer 1 roughly includes the thermal head (stamp face forming part) 4, a stepping motor 9, a guide 14, and a platen roller (conveyance roller) 12, for example, as shown in FIGS. 3, 4A, and 4B. A pair of plate-shaped side frames 13 that are opposite to each other in the direction Y are arranged on both sides of the thermal head 4, the guide 14, and the platen roller 12.

The platen roller 12 serves to covey the stamp face material holder 20 in the direction X, as shown in FIGS. 4A and 4B, and is provided in such a manner as to span between both side frames 13 and 13, and each end of the platen roller 12 pierces through each of the side frames 13. Both end portion of the platen roller 12 are supported by the side frames 13 so as to be rotatable relative to the side frames 13. For example, a roller gear (not shown) is integrally attached to an end portion of an axis +Y of a rotational shaft of the platen roller 12 and a drive force generated by rotation of a drive gear (not shown) attached to a drive shaft of the stepping motor 9 is conveyed through a plurality of electric gears, thereby causing the platen roller 12 to rotate at a predetermined rotational speed.

The guide 14 has an inclined surface 14*a* formed to introduce the stamp face material holder 20 (stamp face material 21) to the platen roller 12. The inclined surface 14*a* is arranged such that, in a view from the direction Y shown in FIG. 4B (a section when seen from the direction +Y), an extension line EL of the inclined surface 14*a* (indicated by a dashed line in the drawing and corresponding to the conveyance path) is arranged to be in contact with an outer peripheral surface of the platen roller 12. Herein, as shown in FIG. 4B, a protrusion height, a shape, and arrangement of the ribs 10*f* provided on the inner surface 10*e* of the ejection port 10*d* are set such that upper surfaces of the rib 10*f* contact with the extension line EL of the inclined surface 14*a*.

As shown in FIG. 4B, a sensor 3 is provided in a recessed portion 14*b* of the inclined surface 14*a*. The sensor 3 is arranged on a −Z side slightly apart from a path of the stamp face material holder 20 so that the sensor 3 does not contact with the stamp face material holder 20. In addition, in a view from the direction Z shown in FIG. 4A (a plan view as seen from a +Z side), the sensor 3 is arranged on a +Y side slightly apart from the side frame 13 of the left side and on a −X side slightly apart from the platen roller 12 so that a notch 22*a* of the stamp face material holder 20 passes over the sensor 3. A detection scanning line SL indicated by a broken line in FIG. 4A intersects with an optical axis L of the sensor 3 and extends in the direction X. The sensor 3 is a reflection type optical sensor and includes a light emitting element emitting light in the direction +Z and a light receiving element receiving light reflected in the direction −Z after impinging on a sensor target (the stamp face material holder 20 herein). The sensor 3 outputs a signal corresponding to an amount of light received by the light receiving element. The signal is used to specify a type (size) of the stamp face material 21 fitted in the stamp face material holder 20.

The thermal head 4 is provided to face the platen roller 12, as shown in FIGS. 2A and 4B. The thermal head 4 presses the stamp face material 21 on the stamp face material holder 20 conveyed in the direction X, through the film 24. A pressing member 4*a* of the thermal head 4 for pressing the stamp face material 21 is provided in a straight band shape along the direction Y. Herein, a length of the pressing member 4*a* (a length thereof in the direction Y) is set to be longer than a width of the stamp face material 21 (a length thereof along the direction Y), whereby a straight band-shaped region extending along the width direction of the stamp face material 21 is uniformly pressed by the pressing member 4*a* and thereby deformed. On the pressing member 4*a* are arranged a plurality of heating elements (not shown) that are to be selectively heated when forming a stamp face (platemaking), along an extension direction (direction Y) of the pressing member 4*a*. In addition, the thermal head 4 includes an IC (integrated circuit) chip (driver IC) 4*b* provided with a drive circuit for controlling a heat generating state of each of the plurality of heating elements arranged on the pressing member 4*a*. The driver IC 4*b* is arranged at a position, for example, in a direction (direction −X) opposite to the conveying direction for the stamp face material holder 20 with respect to the pressing member 4*a* provided with the plurality of heating elements. Due to such a structure, in the straight band-shaped portion of the stamp face material 21 (a portion of the material pressed and deformed by the pressing member 4*a*), a region corresponding to each heating element that is heated and generates heat will be heated.

Herein, in the ordinary thermal head 4, the pressing member 4*a* provided with the plurality of heating elements is arranged near the driver IC 4*b* for controlling a heat generating state of each of the heating elements on one surface side of a printed circuit board (PCB). This structure is due to reduction in a size of the printed circuit board and suppression of cost increase, and most general-purpose products employ the above arrangement.

A distance between the thermal head 4 and the platen roller 12 (indicated by "H" in FIG. 2A) may be set to a predetermined constant value according to the structure of the stamp face material holder 20 described later. Alternatively, there may be provided a mechanism (indicated by "32" in FIG. 2A) for moving either the thermal head 4 or the platen roller 12 in the direction Z to adjust the distance H between the thermal head 4 and the platen roller 12. The use of the mechanism 32 for adjusting the distance H between the thermal head 4 and the platen roller 12 allows a change in a pressing force for pressing the thermal head 4 onto the stamp face material 21. Particularly when forming a stamp face (platemaking) by using the stamp face material holder 20 that holds a stamp face material 21 having a different size (particularly, a size thereof in the width direction is different), the state of pressing by the pressing member 4*a* of the thermal head 4 sometimes change depending on the size of the stamp face material 21. Thus, the adjustment mechanism 32 for adjusting the distance H between the thermal head 4 and the platen roller 12 is significantly useful for appropriately forming the stamp face. The distance H adjustment mechanism 32 performs adjustment control for the distance H, for example, based on a size of the stamp face material 21 of the stamp face material holder 20 specified by the controller 2 by scanning the notch 22*a* of the stamp face material holder 20 using the sensor 3. Herein, as the distance H is set to be smaller, the pressing force of the thermal head 4 pressing the stamp face material 21 becomes larger.

(Functional Structure that Functions Under Control of Controller (CPU))

Next, a description will be given of a functional structure of the printer 1 according to the first embodiment, that is, a functional structure thereof that functions under control of the controller (CPU).

Figure 5:
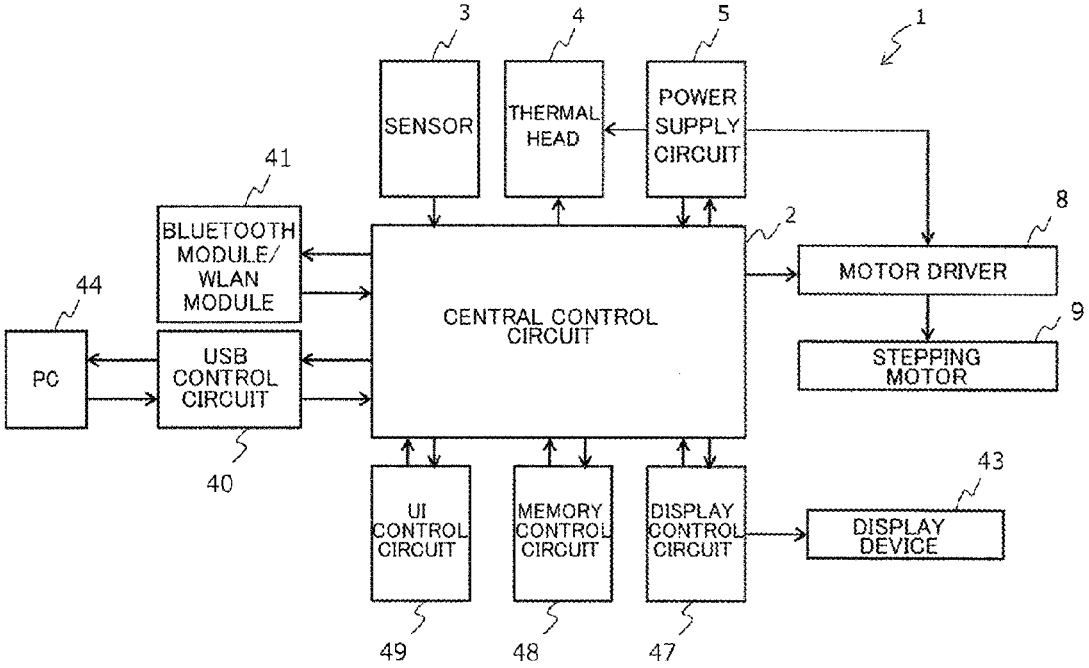
FIG. 5 is a block diagram of a system structure of the stamp face forming apparatus according to the first embodiment.

FIG. 5 is a block diagram of a system structure of the stamp face forming apparatus (printer 1) according to the first embodiment.

As shown in FIG. 5, the printer 1 includes a central control circuit 2 that is connected to the sensor 3, the thermal head 4, a power supply circuit 5, a motor driver 8, a display screen control circuit 47, a memory control circuit 48, a UI (user interface) control circuit 49, a USB control circuit 40, and a Bluetooth (registered trademark) module/wireless LAN module 41.

Additionally, the stepping motor 9 is connected to the motor driver 8, and a display device 43 is connected to the display (screen) control circuit 47, and a PC (personal computer) 44 is connected to the USB control circuit 40.

In the present example, the sensor 3 includes a reflection type optical sensor and detects the notch 22*a* formed on the stamp face material holder 20. The central control circuit 2 detects a signal from the sensor 3 to perform detection of a printing start position, a media size, and the like and electric control.

In addition, not all of the display device 43, the display screen control circuit 47, the UI control circuit 49, the USB communication control circuit (USB communication control circuit) 40, Bluetooth (registered trademark) module/wireless LAN module 41, and the like are always necessary.

In FIG. 5, the central control circuit (controller) 2 performs control of the entire system. In the drawing, most of the circuits are connected only to the central control circuit 2, but obviously the circuits can also be connected to each other to mutually perform data communication through buses. The central control circuit 2 is a circuit including the CPU and performs various functions (for example, detection of an amount of conveyance, size setting, size determination, positional detection, heating control, pressing force control, and the like) by reading and executing a computer program by the CPU as needed.

The memory control circuit 48 includes devices such as a read only memory (ROM) and a random access memory (RAM) and controls the devices. The display device 43 refers to a display device, for example, such as a liquid crystal display (LCD), and the display image control circuit 47 controls data transfer and the like to the display device 43 and turning on/off and the like of a backlight.

In addition, a computer program necessary to perform various functions is stored in the ROM or the like, and as needed, the program is written on the RAM, referenced and then used. The stamp face forming apparatus of the embodiment works in collaboration with a computer (or a smart phone) by installing driver software and an application program in the computer (or the smart phone) and using a USB connection or the like. Accordingly, the computer program in the stamp face forming apparatus collaborates with the computer program installed in an external device such as a computer to achieve various functions.

For example, in the case of a stamp face forming apparatus (printer) of a model for which wired or wireless connection to the PC 44 is essential, the user performs operation by the PC 44 or a graphical user interface (GUI) such as a not-shown portable phone terminal, so that the display screen control circuit 47 and the display device 43 are not essential for the hardware.

The UI (User Interface) control circuit 49 controls a menu screen display and the like based on information that the user inputs from an input device such as a keyboard, a mouse, a remote controller, a button, or a touch panel through a computer or the like, or through an input device provided in the present stamp face forming apparatus (printer). The power supply circuit 5 includes a power supply IC (Integrated Circuit) or the like and generates a power supply voltage necessary for each circuit to supply the voltage thereto.

The thermal head 4 receives data and a print signal output from the central control circuit 2 to perform control for electrification dots by the driver IC included in the thermal head, and performs printing (formation of a stamp face; the same applies hereinafter) on a stamp face material such as a porous ethylene vinyl acetate (hereinafter referred to as EVA) copolymer or the like in contact with the thermal head. The "printing" by the present stamp face forming apparatus does not refer to printing using ink but refers to perform processing regarding whether the surface of the stamp face material 21 is made non-porous or not for each dot by selectively heating the plurality of heating elements of the thermal head 4 according to image data.

In the exemplary structure of the present system, the other circuits receive only data and signals from the central control circuit 2 and obtain power necessary for printing from the power supply circuit 5. In addition, in the apparatus of the present example, the thermal head 4 has an effective printing width of 48 mm at 200 dpi, that is, at a resolution of 200 dots/25.4 mm (a resolution of 0.125 mm per dot).

The motor driver 8 is a drive circuit for driving the stepping motor 9 and receives a signal output from the central control circuit 2 to supply a drive pulse signal and electric power to the stepping motor 9. The motor driver 8 receives only an excitation signal from the central control circuit 2 and obtains an actual drive electric power from the power supply circuit 5.

The controller (central control circuit) 2 counts the number of pulses of the signal output to the motor driver 8 and can accurately know an amount of rotation of the stepping motor 9, that is, how many millimeters the stamp face material holder has been conveyed by the platen roller 12.

The printer 1 of the present embodiment employs a 1-2 phase excitation drive mode, and a gear ratio of the motor is set to 16 steps per line (0.125 mm). In other words, a conveyance distance per step is 0.0078 mm.

Calculation of the distance of conveyance by the platen roller 12 in the controller 2 may be performed not based on the number of pulses but by another method. For example, the number of rotations of the platen roller 12 may be detected by a rotary encoder and then, based on the number of the detected rotations, the distance of conveyance by the platen roller 12 may be calculated.

(Structure of Stamp Face Material Holder)

Next, a description will be given of the stamp face material holder 20 where a stamp face is formed (platemaking) by the printer 1, with reference to FIGS. 6A, 6B, 6C, 7A, and 7B.

Figure 6A:
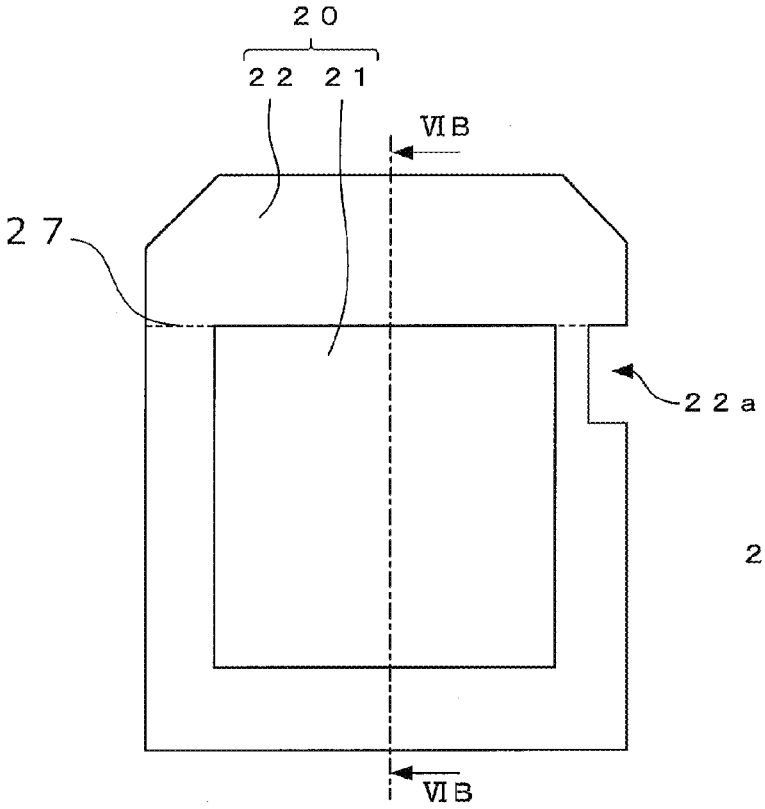
FIG. 6A is a plan view showing an example of the stamp face material holder for holding a stamp face material on which a stamp face is to be formed by the stamp face forming apparatus according to the first embodiment.
Figure 6B:
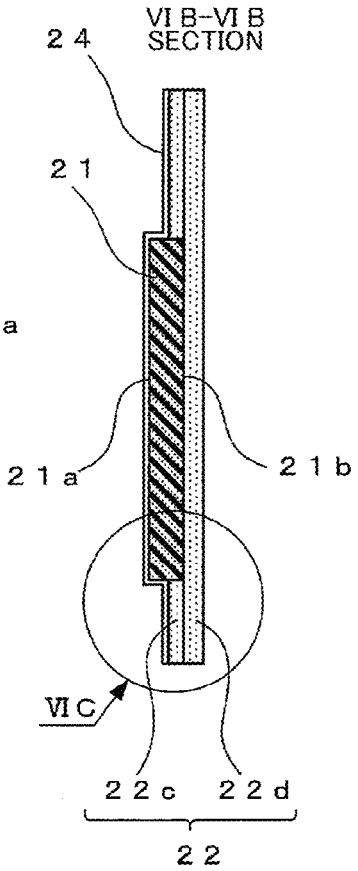
FIG. 6B is a sectional view taken along line VI B-VI B of FIG. 6A, that is, a sectional view obtained by cutting in a vertical plane including the conveying direction.
Figure 6C:
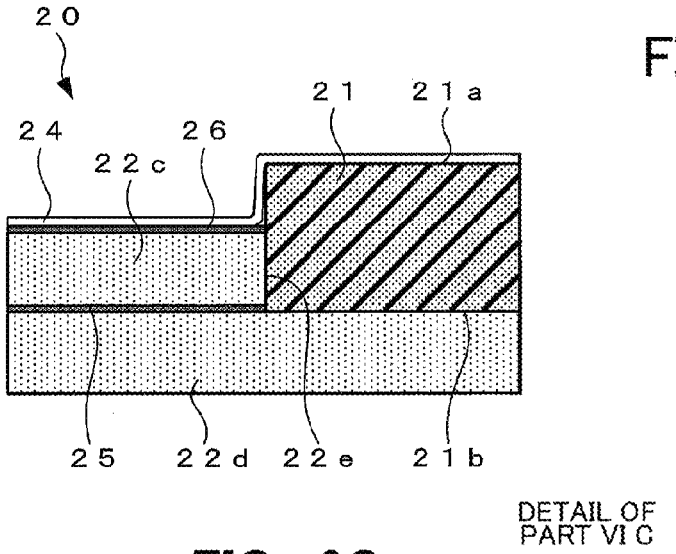
FIG. 6C is a sectional view showing a detail of a part VI C enclosed by a circle in FIG. 6B.
Figure 7A:
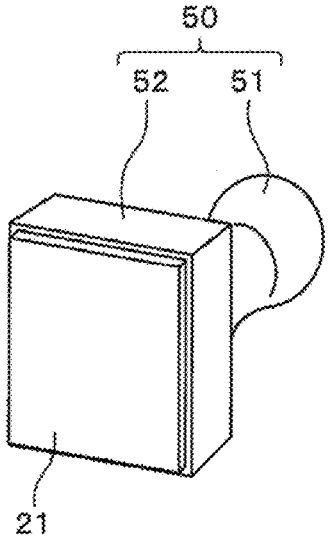
FIG. 7A is an external perspective view showing a state in which after completing the formation of the stamp face, the stamp face taken out from the stamp face material holder has been attached to a wooden stamp base to obtain a stamp.
Figure 7B:
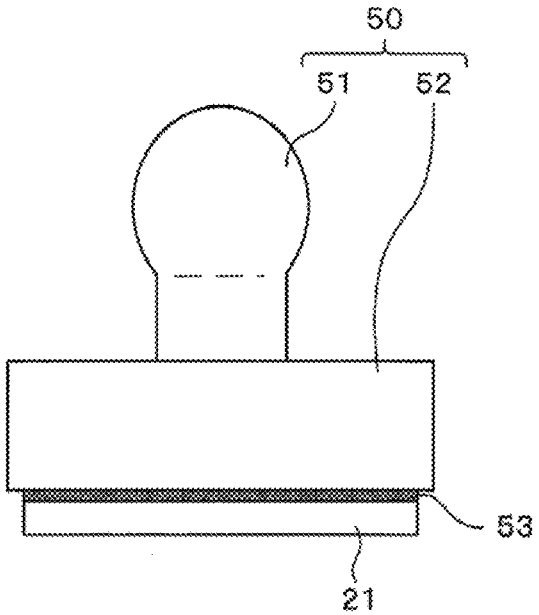
FIG. 7B is a side view of the completed stamp shown in FIG. 7A.

FIG. 6A is a schematic diagram showing an example of a stamp face material holder where formation of a stamp face is performed by the printer of the first embodiment, and is a plan view showing a stamp face-formed side of the stamp face material holder 20 (a side thereof holding the stamp face material 21). FIG. 6B is a schematic sectional view showing a sectional structure along a line VI B-VI B shown in FIG. 6A (for convenience, the present specification uses "VI" as a character corresponding to the Roman numeral "6" indicated in FIG. 6A). FIG. 6C is a sectional view of a main part showing the sectional structure in a part VI C shown in FIG. 6B. FIG. 7A is a schematic view showing an example of a stamp to which a stamp face material with a stamp face formed thereon has been attached and is a perspective view of the stamp as seen from the stamp face material side. FIG. 7B is a side view of the stamp with the stamp face material side facing a bottom thereof (a state in which the stamp is put on paper or the like when used).

The stamp face material holder 20 includes the stamp face material 21, the holding body 22 for holding the stamp face material 21, and the protection film 24 for protecting the stamp face material 21. As shown in FIGS. 6A and 6B, the holding body 22 holds the stamp face material 21 in such a manner as to fix to the center of the holder.

The stamp face material 21 includes a main surface 21*a* that will become an actual stamp face. The stamp face material 21 includes, for example, a porous ethylene vinyl acetate copolymer (hereafter abbreviated as "EVA") and can be deformed by pressing. The EVA contains a myriad of air bubbles, into which ink is impregnated.

In the stamp face material holder 20, the holding body 22 and the film 24 are tools used when forming a stamp face of the stamp face material 21. After completing the formation of a stamp face, the holding body 22 and the film 24 are separated from the stamp face material 21 and discarded (or recycled). The holding body 22 includes a laminate of an upper paper board 22*c* and a lower paper board 22*d* that include a coated cardboard, as shown in FIGS. 6B and 6C. In addition, as shown in FIG. 6A, the notch 22*a* is formed on one side portion of the holding body 22 (right in the drawing). Herein, the holding body 22 has, for example, a white surface in order to allow light from the sensor 3 to be reflected with high reflectivity.

On the upper paper board 22*c* is formed a positioning hole 22*e* for fixing the stamp face material 21 at the center thereof, as shown in FIGS. 6B and 6C. The stamp face material 21 is fitted into the positioning hole 22*e* and fixed therein. The lower paper board 22*d* is formed so as to have the same outer shape as that of the upper paper board 22*c*, and does not have the positioning hole 22*e*, as FIGS. 6A and 6B. The lower paper board 22*d* is in contact with the entire part of a back surface 21*b* of the stamp face material 21 in a state in which the lower paper board 22*d* and the upper paper board 22*c* has been laminated together.

The main surface 21*a* of the stamp face material 21 (a left surface in FIG. 6B or an upper surface in FIG. 6C) is formed in such a manner as to slightly protrude from an upper surface of the upper paper board 22*c* (the left surface in FIG. 6B or the upper surface in FIG. 6C), as shown in FIGS. 6B and 6C. In the first embodiment, a total thickness of the upper paper board 22*c* and the lower paper board 22*d* is set to, for example, 1.2 mm, whereas a total thickness of the stamp face material holder 20 including the film 24 and the stamp face material 21 is set to, for example, to 1.8 mm. In other words, in this example, the stamp face material 21 is set to protrude by 0.6 mm from the upper paper board 22*c*.

In addition, as shown in FIGS. 6B and 6C, the stamp face material holder 20 includes the film 24 for covering the upper surface of the holding body 22 and the upper surface of the stamp face material 21. The film 24 is made by using polyethylene terephthalate (PET), polyimide, or the like, as a base material, and has thermal resistance, heat conductivity, and surface smoothness. Herein, regarding the thermal resistance of the film 24, the film used can be resistant to higher temperatures than a temperature of the thermal head in the formation of a stamp face and a melting point of the stamp face material 21. In addition, regarding the heat conductivity of the film 24, the film used can transmit heat of the thermal head 4 to the stamp face material 21 in the formation of a stamp face so that the stamp face material 21 can be well melted. As for the surface smoothness of the film 24, the film used allows the pressing member 4*a* of the thermal head 4 contacted with the film upon the formation of a stamp face to slide moderately in a less frictional state.

As shown in FIG. 6C, the upper paper board 22*c* and the lower paper board 22*d* are laminated together by, for example, a double-sided adhesive sheet 25. In addition, the film 24 is adhered to a surface of a peripheral part of the holding body 22, that is, the surface of the upper paper board 22*c* in which the stamp face material 21 is fitted, by a double-sided adhesive sheet 26. The film 24 and the stamp face material 21, and the stamp face material 21 and the lower paper board 22*d*, respectively, are merely in contact with each other but not laminated together.

FIGS. 6A to 6C have shown merely one example of the stamp face material holder 20 that is to be a target object for formation of a stamp face by the printer 1 according to the present embodiment. However, a plurality of kinds of stamp face material holders 20 for holding stamp face materials 20 having different sizes (sizes thereof in longitudinal and transverse directions of FIG. 6A) can be used as the target object for formation of a stamp face. Herein, thicknesses and widthwise sizes (sizes in the transverse direction of FIG. 6A) of the respective kinds of stamp face material holders 20, respectively, are set to be the same, whereas lengthwise sizes (sizes in the longitudinal direction of FIG. 6A) of the stamp face material holders 20 are set to be different according to the size of the stamp face material 21. Additionally, the notch 22*a* that is different in size (for example, size in a longitudinal direction thereof) is formed on respective holding bodies 22 in a relationship of 1 to 1 according to the sizes of the stamp face materials 21 of the respective kinds of stamp face material holders 20. Then, the kinds (sizes) of the stamp face materials 21 of the respective stamp face material holders 20 are specified by scanning the notch 22*a* of the holding body 22 through the sensor 3 of the printer 1 to detect the size of the notch 22*a*.

The stamp face material 21 is taken out from the holding body 22 after completion of the formation of a stamp face by the printer 1. Next, for example, as shown in FIGS. 7A and 7B, the stamp face material 21 taken out is attached to a lower surface of a wooden base 52 (a surface of a lower side of the wooden base 52 in FIG. 7B) of a stamp 50 including a spherical handle 51 and the quadrate wooden base 52 by a double-sided adhesive sheet 53 or the like.

(Principle of Stamp Face Formation)

Next, a description will be given of a principle for forming a stamp face on the stamp face material 21.

The stamp face material 21 includes EVA. EVA has thermoplastic physical properties. Accordingly, when the material is heated at a temperature of, for example, from 70 to 120° C., a heated region of the material is softened, and the region once softened is hardened after being cooled. Then, the air bubbles are embedded in the hardened region and the region is made non-porous, so that the region does not allow ink to pass therethrough.

The printer 1 according to the present embodiment uses the characteristics of the stamp face material 21 (EVA) to heat an arbitrary region of a surface of the EVA by the thermal head at around from about 1 to about 5 msec, thereby making the arbitrary region of the surface of the EVA non-porous to inhibit ink from passing through the region. The stamp face material 21 is cut into a quadrate shape by a heating cutter in advance. Accordingly, all of four side faces (end faces) of the stamp face material 21 are already made non-porous by heat applied due to the cutting and thus do not allow ink to pass therethrough. In addition, the back surface 21*b* of the stamp face material 21 is also already subjected to heating treatment and thus does not allow ink to pass therethrough. This prevents ink from oozing out from surfaces other than the main surface 21*a* that is to be a stamp face.

In the formation of a stamp face (thermal printing), non-heating a region allowing the passage of ink and heating a region inhibiting the passage of ink allows the formation of a region through which ink passes in accordance with a seal pattern desired to be left by impressing a stamp. Considering that an error can occur during the formation of a stamp face and the side faces of the stamp face material 21 do not allow ink to pass through, the size of the stamp face material 21 is set to be slightly larger than a size of the seal pattern. For example, when the seal pattern has a size of 45 mm×45 mm, the size of the stamp face material 21 is set to 48 mm×48 mm.

(Operation for Forming Stamp Face)

Next, a description will be given of a stamp face forming operation for forming a stamp face by the printer 1 according to the present embodiment. Each function shown below is stored in a form of a readable program code in the controller 2 (more particularly, the ROM), and operation in accordance with the program code is sequentially executed. As shown in the system block diagram of FIG. 5, the stamp face forming apparatus (printer 1) usually operates in collaboration with a personal computer, a smart phone, or the like. Herein, in order to simplify the description, only an operation executed in the printer 1 will be described.

Figure 8A:
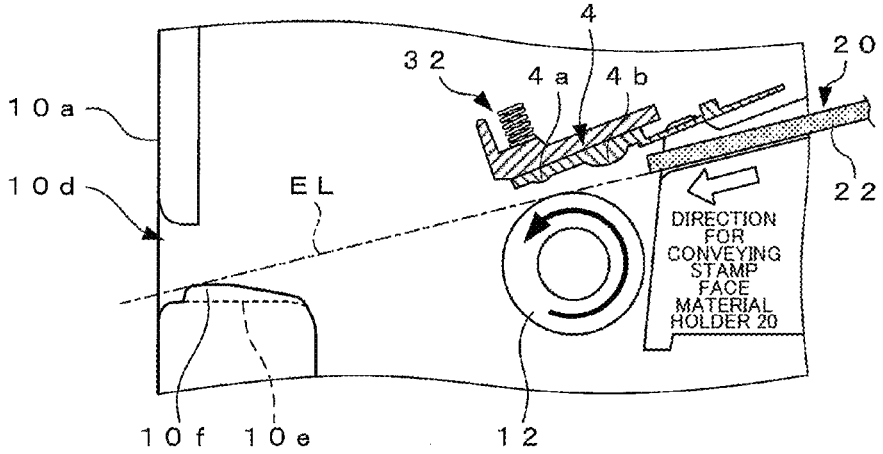
FIGS. 8A, 8B, and 8C are schematic sectional views showing situations in which the stamp face is being formed by a printer according to the first embodiment.
Figure 8B:
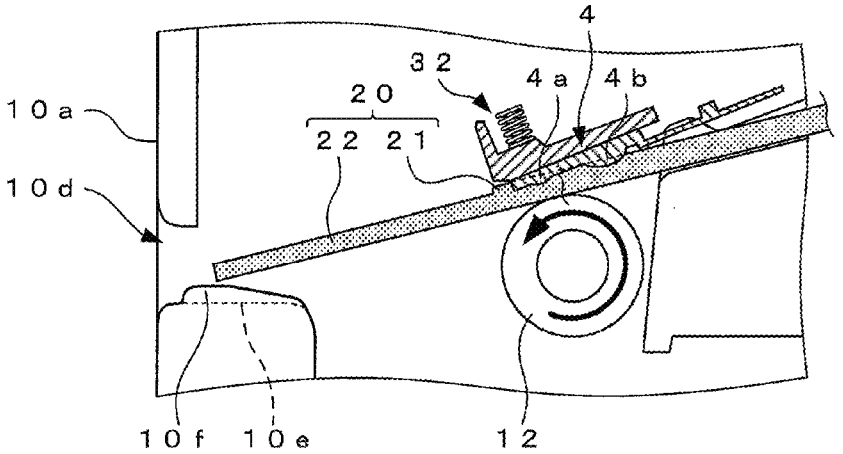
Figure 8C:
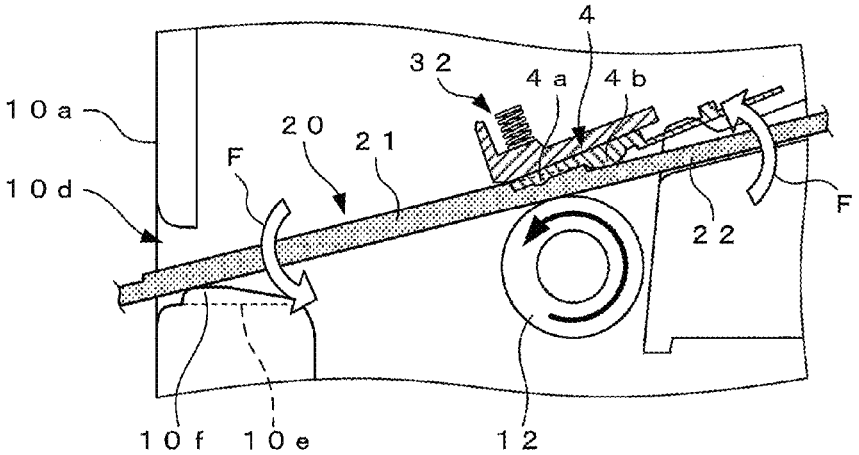

FIGS. 8A to 8C are schematic sectional views showing a state in which a stamp face is formed by the printer according to the first embodiment.

In the stamp face forming operation by the printer 1, first, the controller 2 executes an initial operation of the printer 1 when the input operator 6 is pressed and then a signal for starting the printer 1 is input from the input operator 6. In the initial operation of the printer 1, the controller 2 sends a drive signal to the motor driver 8 to rotate the stepping motor 9 only for a predetermined time, thereby rotating the platen roller 12 only for the predetermined time. Accordingly, even when the stamp face material holder 20 is left in the printer 1, the stamp face material holder 20 is ejected outside the printer 1 from the ejection port 10*d*.

After ending the initial operation, the controller 2 rotates the stepping motor 9 to rotate the platen roller 12 when a start signal for starting formation of a stamp face (for example, a signal output from the input operator 6 after the above initial operation, which is a signal indicating that the input operator 6 has been pressed) is input from the input operator 6 in a state in which a person operating the printer 1 has inserted the stamp face material holder 20 in the printer 1 from the insertion port 10*c*, as shown in FIG. 8A. Thereby, the stamp face material holder 20 is conveyed in the direction +X along the guide 14 (inclined surface 14*a*).

Herein, in the case in which a plurality of kinds (sizes) of stamp face material holders 20 are target objects used for forming a stamp face, the controller 2 causes the sensor 3 to detect the length of the notch 22*a* of the stamp face material holder 20 (holding body 22) so as to specify the kind of the stamp face material holder 20 (the size of the stamp face material 21). Then, based on the kind of the stamp face material holder 20 specified, the controller 2 controls the adjustment mechanism 32 for adjusting the distance H between the thermal head 4 and the platen roller 12 to set a distance H corresponding to the kind of the stamp face material holder 20. In this way, the pressing force of the thermal head 4 applied on the stamp face material 21 is appropriately set according to the kind of the stamp face material holder 20.

Then, as shown in FIG. 8B, when the stamp face material holder 20 is conveyed farther in the direction +X, the pressing member 4*a* of the thermal head 4 reaches the stamp face material 21 through the upper surface of the holding body 22. The stamp face material 21 of the stamp face material holder 20 is pulled in under the thermal head 4, conveyed while being pressed by a predetermined pressing force, and heated by the plurality of heating elements arranged in the direction Y on the pressing member 4*a* of the thermal head 4, resulting in formation of a stamp face.

Specifically, based on image data that has been input, the controller 2 controls while causing the conveyance of the stamp face material holder 20 (rotation of the stepping motor 9) to be operated in concert with heating of any of the plurality of heating elements of the thermal head 4, so that positions of the stamp face material 21 corresponding to the image data are selectively heated to form an ink permeable portion and an ink non-permeable portion according to the image data, thereby forming a stamp face.

In this case, due to the EVA applied to the stamp face material 21, which is a porous sponge body and very soft, it is necessary to press the plurality of heating elements of the thermal head 4 onto the stamp face material 21 of the stamp face material holder 20 more strongly than in a printer performing ordinary thermal printing, in order to appropriately perform stamp face formation (thermal printing). Thus, as shown in FIGS. 6B and 6C, the main surface 21*a* of the stamp face material 21 is formed so as to protrude from the upper surface of the holding body 22. Additionally, in the state in which the thermal head 4 is pressed on the stamp face material 21 of the stamp face material holder 20, not only the pressing member 4*a* with the plurality of heating elements of the thermal head 4 but also the driver IC 4*b* arranged near the plurality of heating elements is pressed on the stamp face material 21 to be dug thereinto, as shown in FIG. 8B.

Then, when the stamp face material holder 20 is conveyed farther in the direction +X while the stamp face is being formed on the stamp face material 21, the thermal head 4 reaches an end portion (a terminal portion) in the direction −X of the stamp face material 21 and passes through a boundary portion between the stamp face material 21 and the holding body 22, as shown in FIG. 8C. At this time, an end portion in the conveying direction (direction +X) of the holding body 22 of the stamp face material holder 20 reaches at least the ejection portion 10*d*, and the plurality of ribs 10*f* provided on the inner surface 10*e* of the ejection port 10*d* contact with a back surface side of the holder (a surface thereof opposite to the side for forming a stamp face on which the thermal head is pressed, that is, a lower surface side in the drawing) near the ejection port 10*d* to support the stamp face material holder 20.

Herein, since the stamp face material 21 is formed so as to protrude from the holding body 22 in the thickness direction thereof, there is a step at the boundary portion therebetween. Additionally, the driver IC 4*b* is located near the pressing member 4*a* of the thermal head 4 (in the direction −X). Besides, the thermal head 4 is strongly pressed on the stamp face material 21. Thus, when the thermal head 4 passes by the above boundary portion, first, the driver IC 4*b* of the thermal head 4 descends from the step. In this situation, the pressing force applied to the stamp face material holder 20 (stamp face material 21) by the driver IC 4*b* of the thermal head 4 is momentarily cancelled. Then, as indicated by an arrow F in FIG. 8C, a force for rotating the stamp face material holder 20 (a force urging the end portion in the direction +X of the holder downwardly and urging the end portion in the direction −X thereof upwardly) is applied.

Herein, in a structure in which the ribs 10*f* are not arranged at the ejection port 10*d* of the printer 1, the end portion in the direction +X of the stamp face material holder 20 is not supported. Due to this, at a moment when the driver IC 4*b* of the thermal head 4 descends from the step between the stamp face material 21 and the holding body 22, the stamp face material holder 20 is rotated by the force F occurring on the stamp face material holder 20, thereby changing an amount of conveyance (conveyance density) of the stamp face material holder 20 by the platen roller 1. Accordingly, printing unevenness (for example, concave and convex portions extending linearly in the direction Y) due to the changed amount of conveyance occurs on the main surface 21*a* of the stamp face material 21 where a stamp face is to be formed, so that the stamp face may not be formed appropriately.

In contrast, in the present embodiment, as shown in FIGS. 2A, 2B, 4A, and 4B, on the lower inner surface 10*e* of the ejection port 10*d* are arranged the plurality of ribs (protruding members) 10*f* formed such that the upper surfaces of the ribs 10*f* contact with the extension line EL of the inclined surface 14*a* as the conveying path for the stamp face material holder 20 conveyed during the stamp face forming operation. In this manner, the stamp face material holder 20 is supported on the conveying path by the inclined surface 14*a*, the platen roller 12, and the plurality of ribs 10*f* provided at the ejection port 10*d*. This structure suppresses the phenomenon in which the stamp face material holder 20 is rotated by the force F occurring on the stamp face material holder 20 at the moment when the driver IC 4*b* of the thermal head 4 descends from the step between the stamp face material 21 and the holding body 22, so that stamp face formation is performed appropriately.

Then, when the stamp face material holder 20 is conveyed farther in the direction +X and the formation of a stamp face on the stamp face material holder 20 is completed, the stamp face material holder 20 is ejected from the ejection port 10*d* of the printer 1. After that, the controller 2 stops the stepping motor 9 to stop the platen roller 12 and ends the series of stamp face forming operation. Herein, a timing for stopping the stepping motor 9 by the controller 2 is set to, for example, a point in time after a predetermined time passes from a point in time at which a rear end of the stamp face material holder 20 has passed by the sensor 3.

(Roles of Holding Body 22 and Film 24)

The EVA is a member having a thickness of 1.5 mm and has high elasticity and high friction coefficient. Accordingly, even if the EVA is inserted as it is in the thermal printer and tried to be conveyed, a large frictional force generated between the thermal head and the EVA hinders stable rectilinear conveyance. In other words, due to the large frictional force and the rubber-like softness of the EVA, the EVA itself bends when any little bending occurs during conveyance, even though the guide for obtaining rectilinear stability is provided on the thermal printer, as a result of which oblique travel occurs immediately.

The difficulty in the conveyance of the EVA described above is a phenomenon occurring also in a non-heating state in which the thermal head is generating no heat. Meanwhile, when the thermal head generates heat, the thermal head is heated up to a temperature close to about 200° C. in a few milliseconds after starting to generate heat. Thereby, the EVA surface is softened at a moment when heated and then the thermal head is embedded in a softened portion of the EVA, causing a phenomenon that completely makes the conveyance of the EVA impossible.

In cases of a system using an end face head and a system incorporating a carriage for moving and driving a head, there occurs no such a problem described above. These systems, however, are disadvantageous in terms of enlargement of mechanism and significant increase in cost for members to be used.

The embodiment uses the stamp face material holder 20 and the holding body 22 and provides protection with the film 24, since a stamp face is formed on the EVA having the conveyance difficulty as described above, as a stamp face plate, by the printer 1 with an ordinary thermal head, without causing enlargement of mechanism and significant cost increase.

In addition, the stamp face material 21 is positionally fixed by the positioning hole 22*e* of the upper paper board 22*c* and held from the lower surface thereof by the lower paper board 22*d*, as well as the upper surface of the stamp face material 21 is covered with the film 24. As a result, the stamp face material 21 maintains a configuration thereof in the state of being held by the stamp face material holder 20 and is not deformed even when an external force in the direction X and/or the direction Y is applied thereto.

Accordingly, the stamp face material 21 is also conveyed in accordance with the conveyance of the stamp face material holder 20. When the stamp face material holder 20 is conveyed rectilinearly, the stamp face material 21 is also rectilinearly conveyed accordingly. In addition, the film 24 is thermally resistant to higher temperatures than a melting point of the stamp face material 21, namely, of the EVA.

The film 24 is, thus, not melted even when the surface of the stamp face material 21 is melted due to heat generation of the thermal head 4. In other words, the film 24 does not lose the covering ability as a film. Additionally, the film 24 has extremely low frictional force against the thermal head 4.

Thermal head 24 can therefore easily continue to perform thermal printing (stamp face formation) along a surface of the film 24, without being embedded in the melted and softened stamp face material 21 due to the covering ability of the film 24, as well as due to the less frictional properties of the film 24. In this way, the formation of a stamp face on the stamp face material 21 is completed.

(How to Use Stamp Face Material Taken Out after Formation of Stamp Face)

In this way, heating the surface of the EVA by the thermal head based on print data allows the formation of a stamp face having a user's original seal pattern. In order to take out the stamp face plate obtained by forming the stamp face on the stamp face material from the stamp face material holder 20, it is merely enough to bend the holding body 22 along a perforation 27 to pull out the stamp face material 21 therefrom. Then, the stamp face material having the stamp face formed thereon is attached to the wooden base 52, and the stamp face is impregnated with ink for a certain time, or alternatively, when the ink has high viscosity, the ink is applied on the stamp face and allowed to stand only for a predetermined time, so that the ink is impregnated into the stamp face plate. The user wipes off contamination made by excess ink on the surface of the stamp face (or performs trial impression of the stamp a few times). Then, when the user grips the handle 51 by the fingers and impresses the stamp on a target object to be stamped, the impregnated ink is pushed out from the stamp face, so that the seal pattern is stamped thereon.

(Necessity of Collapse Suppression)

The stamp face forming apparatus according to an embodiment of the present invention (thermal printer for forming a stamp face) uses the porous thermoplastic EVA or the like as the stamp face material (stamp face forming medium).

However, unlike printing on heat sensitive paper or the like, when printing is performed on the EVA, the stamp face material (stamp face forming medium) itself is degenerated and therefore easily influenced by adjacent dots.

Specifically, when a dot to be heated and a dot to be non-heated are directly adjacent to each other, the dot to be non-heated (a porous portion of the stamp face material contacted with the dot to be non-heated) is influenced by thermal plasticization (thermal contraction) caused by the dot to be heated (a porous portion of the stamp face material contacted with the dot to be heated), consequently causing thermal plasticization (resulting in collapse of the dot).

Thus, an embodiment slightly reduces an amount of heat for a dot to be heated directly adjacent to a dot to be non-heated, thereby suppressing the collapse of the dot (the porous portion of the stamp face material contacted with the dot) to be non-heated.

Figure 9A:
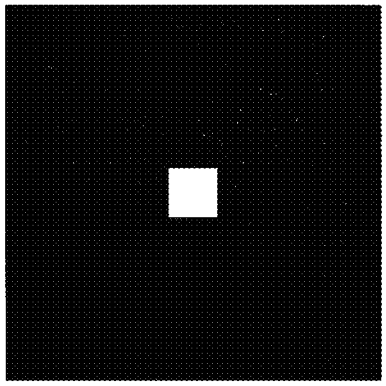
FIGS. 9A and 9B are imaginary diagrams showing how heat is applied.
Figure 9B:
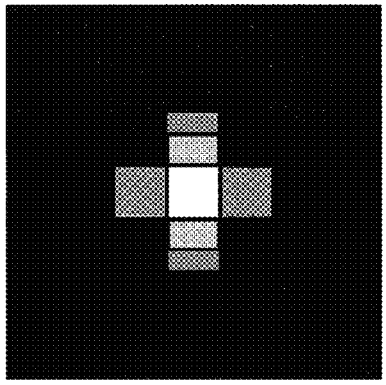

FIGS. 9A and 9B show imaginary diagrams illustrating how heat is applied. These drawings are imaginary views for illustrating how to apply heat for collapse suppression according to an embodiment. FIG. 9A is an illustration showing original image data, that is, image data for forming a stamp face desired by a user. As shown in FIG. 9A, in this image data, a center dot (a white portion) is a dot to which heat is not applied (a dot to be non-heated), whereas all dots (black portions) around the dot are dots to be heated. FIG. 9B is an illustration showing a state in which dots to be heated directly adjacent to a dot to be non-heated are gray colored to indicate that adjustment has been made to slightly reduce the amount of heat. As shown in FIG. 9B, as for the dots adjacent to the right and left of the dot to be non-heated, the amount of heat is reduced in the entire dots. In addition, as for the dots adjacent to the upper and the lower sides of the dot to be non-heated, the amount of heat is reduced in two steps.

FIG. 9B is the imaginary diagram and illustrates an image of a temperature gradient that seems to be preferable as a result of heating control. A target object for the control is absolutely each dot, and it is considered how an electric signal is to be applied to each dot.

(Dot to be Heated and Dot to be Non-Heated)

When the terms "a dot (or dots) to be heated" and "a dot (or dots) to be non-heated" are referred to in the present specification, primarily, the term "a dot (or dots) to be non-heated" refers to a dot (or dots) to be non-heated of the plurality of heating elements of the thermal head and the term "a dot (or dots) to be heated" refers to a dot (or dots) to be heated of the plurality of heating elements thereof, as defined in the section of definitions. Herein, the term "dot" represents each of the heating elements of the thermal head, and the dots are arranged, for example, at a resolution of 200 dpi (200 dots per inch).

According to whether each of the heating elements is heated or non-heated, each of porous portions of the stamp face material is to be heated or non-heated. Thus, unless any confusion arises particularly, a portion to be heated and a portion to be non-heated of the porous portions of the stamp face material will be referred to also as "dot to be heated" and "dot to be non-heated". From this point of view, a dot to be non-heated corresponds to a portion allowing ink to pass therethrough when seen from an image of a stamp face to be formed, whereas a dot to be heated corresponds to a portion inhibiting ink from passing therethrough when seen from the image of the stamp face to be formed.

A unit of a dot of the stamp face material is absolutely determined according to the unit of the heating element of the thermal head. The main scanning direction of the thermal head (the direction in which the heating elements are arranged) is defined by a size itself of the heating element. Similarly, the sub-scanning direction of the thermal head (the direction in which the stamp face material holder 20 is conveyed) is also defined by the size of the heating element. In the present embodiment, however, the sub-scanning direction thereof corresponds to a distance in which the platen roller 12 conveys the stamp face material holder 20 by the operation of the stepping motor 9 with 16 steps. The gear ratio of a gear box (not shown) for transmitting a motive force of the stepping motor 9 to the platen roller 12 is determined such that the distance in which the stamp face material holder 20 is moved by the platen roller 12 based on the 16 steps of the stepping motor 9 exactly matches a dot size of the heating element of the thermal head.

Furthermore, in a stage when image data of the stamp face is given to the stamp face forming apparatus, the image data is data representing 1 or 0 for each one dot of the thermal head. In other words, the image data is data indicating whether each dot is a dot to be heated or a dot to be non-heated. Accordingly, each one of the image data can also be referred to as "dot to be non-heated" or "dot to be heated".

(Electric Control Using Multi-Pulse System)

Next, a specific electric control method will be described below.

First, the stamp face forming apparatus according to embodiments of the present embodiment adopts a multi-pulse system for electric control of the thermal head. The multi-pulse system is a system that includes a series of a plurality of pulses to apply energy to the thermal head. Usually, the multi-pulse system is a technique adopted to perform gradation expression or the like. The present apparatus is a stamp face forming apparatus, and portions of the stamp face allow or do not allow the passage of ink, but there is not an inbetween. Thus, there is no gradation expression.

The reason for adopting the multi-pulse system in the present apparatus is to reduce a peak temperature of the heating elements during electrification. This is because it has been experimentarily confirmed that reducing the peak temperature allows heated portions of the EVA surface to be smoothly finished. Details of the matter will be described later with reference to FIGS. 14A and 14B.

(Division Printing System)

In addition, the present apparatus adopts a division printing system, since an amount of current that can be flown to the thermal head is limited. In other words, the thermal head on a single line is configured to be dividable into a plurality of blocks and driven. In the printing of a single dot line, the number of dots per physical block (for example, 64 dots per block) is counted and then all the physical blocks are put together to determine a logical block so that the total number of the dots does not exceed a predetermined maximum number of driven dots (a dynamic division system).

Since the number of division is large, from 6 to 11 (different depending on the printing width), a use of a single pulse leads to a noticeably indented print result (indentation is noticeable, particularly, in printing of thin lines or the like). Thus, minimization of such indentation is among the reasons for adoption of the multi-pulse system.

(Number of Pulses in Multi-Pulse System)

Additionally, the number of pulses is also changed according to a temperature of a heat dissipation plate of the thermal head detected by a thermistor. Although any specific number of pulses at each temperature is not mentioned here, the number of pulses is assumed to be fixed to 10.

Figure 10:
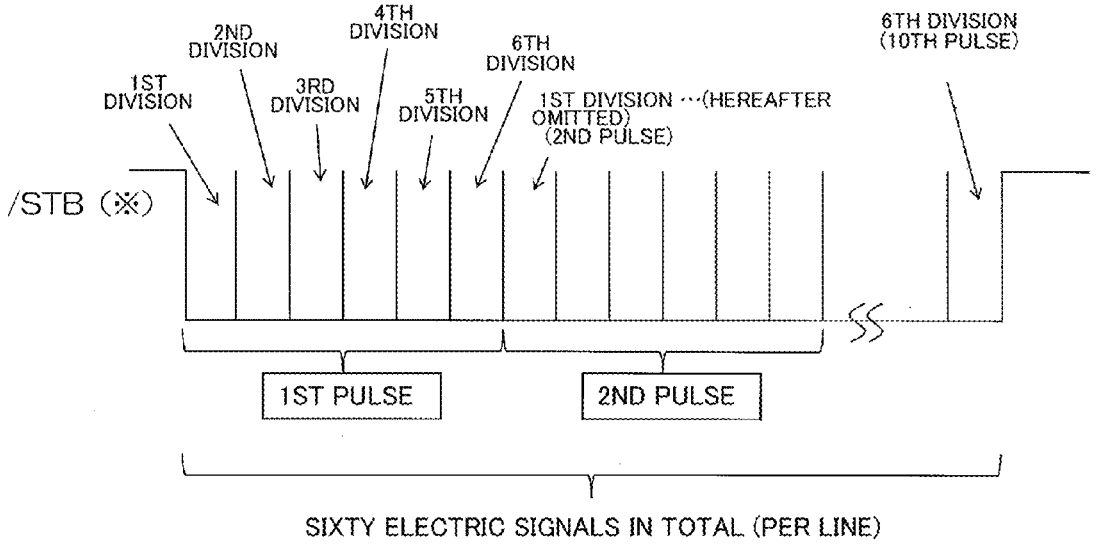
FIG. 10 is a schematic diagram of an electric signal.

In other words, when the number of divisions is six, a total number of electric signals per line is as follows: 10 (pulses)×6 (divisions)=60 (times). FIG. 10 shows a schematic diagram of an actual electric signal. As shown in FIG. 10, the electric signal is transmitted 60 times in total in the following order of: a first division, a second division, a third division, . . . and a sixth division of a first pulse, a first division, a second division, . . . and a sixth division of a second pulse, . . . and a first division, . . . and a sixth division of a tenth pulse. The electric signal causes electric power to be applied to each of the heating elements, so that the heating elements generate heat. The electric signal shown in FIG. 10 (/STB signal) is a low-active signal.

(Three Kinds of Adjacent Patterns)

In the present embodiment, a dot to be heated directly adjacent to a dot to be non-heated is electrified only by an arbitrary number of pulses of the 10 pulses (changed by a temperature detected by the thermistor that is mounted to detect ambient temperature and a temperature of the thermal head).

Figure 11:
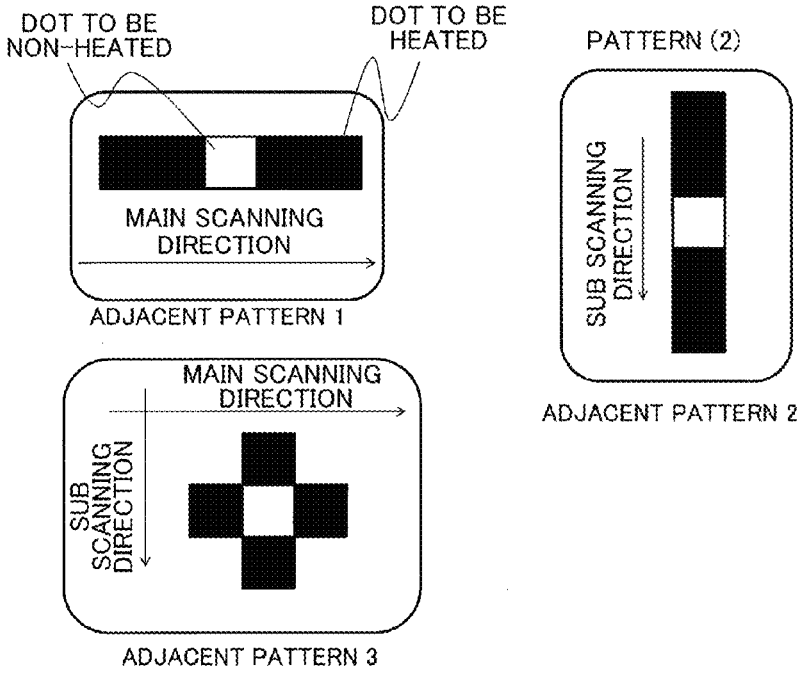
FIG. 11 shows schematic diagrams of adjacent patterns.

Herein, adjacent patterns can be classified into three kinds as shown below (see FIG. 11). FIG. 11 shows three schematic diagrams of adjacent patterns.

(Adjacent Pattern 1): a dot to be non-heated is directly adjacent to a dot to be heated in the main scanning direction of the thermal head (not directly adjacent in the sub-scanning direction thereof).

(Adjacent Pattern 2): a dot to be non-heated is directly adjacent to a dot to be heated in the sub-scanning direction of the thermal head (not directly adjacent in the main scanning direction thereof).

(Adjacent Pattern 3): a dot to be non-heated is directly adjacent to dots to be heated in both of the main scanning direction and the sub-scanning direction of the thermal head.

Herein, the main scanning direction of the thermal head is the same as the arrangement direction of the heating elements of the thermal head, and is a direction orthogonal to the conveying direction of the stamp face material holder. In addition, the sub-scanning direction of the thermal head is the same as the conveying direction of the stamp face material holder, and is a direction orthogonal to the arrangement direction of the heating elements of the thermal head.

Electric control for each adjacent pattern is, for example, performed as follows:

(Adjacent Pattern 1): electrified, for example, by only 8 pulses of the 10 pulses.

(Adjacent Pattern 2): electrified by 8 or 9 pulses of the 10 pulses in such a manner as to avoid a dot to be non-heated.

(Adjacent Pattern 3): the same as the Adjacent Pattern 1 (electrified by 8 pulses of the 10 pulses).

Herein, in the electrification by the 10 pulses, a first pulse is referred to as a first adjustment pulse, second through ninth pulses are referred to as main pulses, and a tenth pulse is referred to as a last adjustment pulse (the sorting varies depending on the temperature detected by the thermistor).

With the use of a concept of the first adjustment pulse, the main pulses, and the last adjustment pulse, collapse suppression can be executed as follows:

(Adjacent Pattern 1): the first adjustment pulse and the last adjustment pulse do not electrify a dot to be heated (dot required to be heated based on data) directly adjacent to a dot to be non-heated, whereas the main pulses electrify the heated dots.

(Adjacent Pattern 2): either the first adjustment pulse or the last adjustment pulse or both thereof do not electrify dot(s) to be heated directly adjacent to a dot to be non-heated in such a manner as to avoid a dot to be non-heated, whereas the main pulses electrify the dot to be heated.

(Algorithm)

Then, a description will be given of an algorithm for creating such print data (see FIGS. 12A to 12F). FIGS. 12A to 12F are diagrams showing adjustment data creating method in the first embodiment. In FIGS. 12A to 12F, black dots represent dots to be heated, and white dots represent dots to be non-heated.

First, the controller 2 develops original data for a single line to be printed (original data (N-th line) shown in FIG. 12B) in a buffer of the RAM.

Next, the controller 2 calculates a logical product of data obtained by shifting the original data to the right by 1 bit and data obtained by shifting original data to the left by 1 bit to make a temporary adjustment data (FIG. 12D). Herein, calculation of the logical product means to obtain the logical product of the two dot data to determine that heat is to be applied only when both data represent "to be heated", whereas heat is not to be applied when one of the data or both thereof represent "to be non-heated".

The temporary adjustment data (FIG. 12D) obtained by the above processing is data in which dots to be heated directly adjacent to each dot to be non-heated are changed to dots to be non-heated in the main scanning direction of the original data.

Next, a logical product of the temporary adjustment data (FIG. 12D) and original data of the previous line (original data (N−1 th line) in FIG. 12A) is referred to as a first adjustment data (FIG. 12E, a first adjustment pulse data), and a logical product of the temporary adjustment data (FIG. 12D) and original data of the next line (original data (N+1th line) in FIG. 12C) is referred to as a last adjustment data (FIG. 12F, a last adjustment pulse data).

The first adjustment data (FIG. 12E) is the logical product data obtained using the original data of the previous line (FIG. 12A). Accordingly, regarding a certain dot (for example, an N-th dot) of the original data (FIG. 12B), when the dot of the previous line is a dot to be non-heated, the dot (the N-th dot) of the first adjustment data becomes a dot to be non-heated regardless of a content of the original data.

The same applies to the last adjustment data.

Herein, in the above description, the original data, the temporary adjustment data, the first adjustment data, the last adjustment data, and the like are sequences of values of 0 or 1 that contain a series of information as to whether each of the heating elements of the thermal head is to be heated or not. The data is referred to as dot data. In other words, the dot data is data representing 0 or 1 for each heating element of the thermal head.

Dot data per line is a sequence of information representing 0 or 1 that should be given to each of the plurality of heating elements of the thermal head according to the direction in which the heating elements are arranged.

Use of the first adjustment data as the first adjustment pulse data described above and the last adjustment data as the last adjustment pulse data described above allows an amount of heat per dot for a dot to be heated directly adjacent to a dot to be non-heated to be less than an amount of heat per dot for a dot to be heated not directly adjacent to a dot to be non-heated, as a result of which the collapse of each dot to be non-heated can be suppressed. FIG. 13 shows a schematic diagram of an electric signal. As shown in FIG. 13, transmitting the electric signal in the order of the first adjustment data, the original data, and the last adjustment data allows for the collapse suppression.

Although the embodiment has performed electric control for only one dot directly adjacent to a dot to be non-heated, a dot that is next adjacent thereto may also be considered. Electric control for such a dot can be achieved, for example, by adding a logical product obtained from data shifted to the right and left by each 2 bits in the creation of temporary adjustment data.

Additionally, regarding the electric control in the embodiment, influence from an oblique angle of 45 degrees is not taken into consideration. The reason for this is that a certain dot (an n-th dot) is most likely to receive heat from the adjacent electrified dots (an (n−1)th dot and an (n+1)th dot) or n-th dots of the previous line and the next line, and 200 dpi thermal head is expected not be much influenced from the oblique angle of 45 degrees.

However, in the case of a print head with high resolution (a print head with small dots), it is necessary to consider influence from the oblique angle of 45 degrees.

In that case, in the creation of first (and last) adjustment data, for example, for an N-th line, it is enough to obtain not only a logical product of temporary adjustment data and (N−1)th (and (N+1)th) line data, but also logical products of the temporary adjustment data and data obtained by bit-shifting the (N−1)th (and (N+1)th) line data to each of the right and left.

However, since it is less likely to receive influence from dots positioned at the oblique angle of 45 degrees than influence from dots of the previous and next lines and the right and left sides, it is enough to create, for example, first adjustment data 1 (in consideration of influence from the oblique angle of 45 degrees) and first adjustment data 2 (without considering influence from the oblique angle of 45 degrees, that is, as in the control of the above embodiment) and perform electrification by a first pulse containing the first adjustment data 1, a second pulse containing the first adjustment data 2, and a third pulse and thereafter containing original data.

Obviously, the same should apply also to last adjustment data.

Figure 14A:
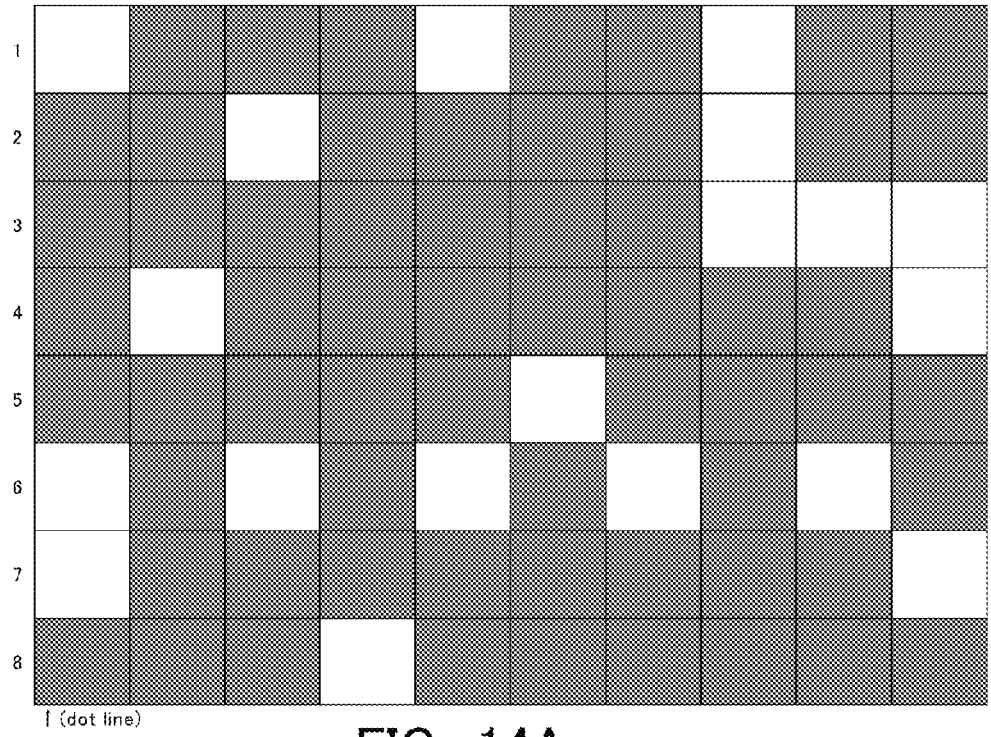
FIGS. 14A and 14B are diagrams showing an example of performing adjustment for controlling collapse suppression on image data.
Figure 14B:
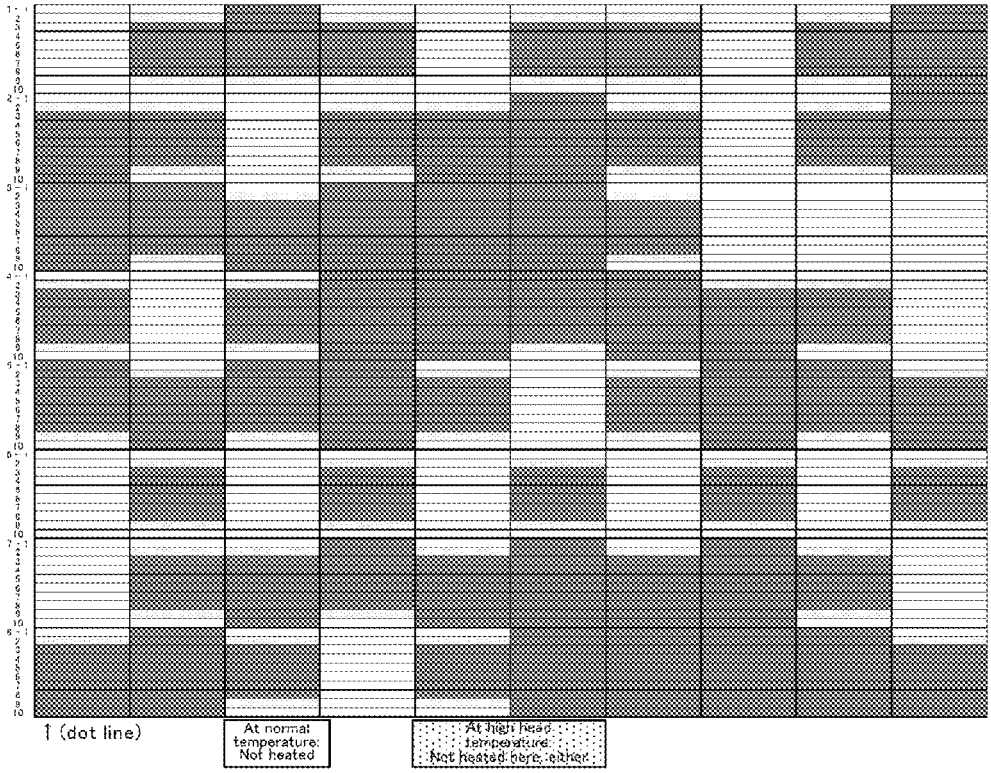

FIGS. 14A and 14B are diagrams showing an example of image data subjected to adjustment of collapse suppression control. FIG. 14A shows image data of which a user desires to make a stamp face. Each of squares shown in FIG. 14A represents each dot. In the image data, each dot is data representing 0 or 1. Black dots (filled dots) represent 1 (dots to be heated), and white dots represent 0 (dots to be non-heated).

FIG. 14B is a diagram showing a result of adjustment performed for the collapse suppression control according to the embodiment of the present invention. Each dot is divided into ten pieces since the number of pulses in the multi-pulse system is set to 10. Blank portions shown in FIG. 14B represent portions to be non-heated at normal temperature. In addition, shaded portions represent those that are also to be non-heated when the thermal head is at high temperature. Black (filled) portions are those to be heated. In other words, dots to be non-heated are not electrified by all the 10 pulses, whereas dots to be heated that are not directly adjacent to the dots to be non-heated are electrified by all the 10 pulses. On the other hand, according to the adjacent patterns described above, dots to be heated that are directly adjacent to the dots to be non-heated are not electrified by at least one of a first adjustment pulse as the first pulse and a last adjustment pulse as the tenth pulse. Furthermore, when the temperature of the thermal head is high, electrification is not performed also by the second pulse and the ninth pulse. In this way, the amount of heat for the dots to be heated directly adjacent to the dots to be non-heated is controlled, thereby suppressing the collapse of the dots to be non-heated.

Herein, while the drawing shows the state in which each single dot is divided into 10 pieces, the division into the 10 pieces has merely been shown for convenience and represents not a spatial division but a structure in which energy applied to one dot includes a series of 10 pulse signals. A sum of the 10 signals determines an amount of energy to be applied to the dot (an amount of heat).

Herein, the order of the 10 signals is determined by imaging so that a natural temperature gradient is formed, and is based on results of experiments conducted according to combinations of various temperature conditions and black dot ratios (ratios of dots to be heated). It is difficult to measure a state of an actual temperature gradient (temperature distribution) in each dot.

The data shown in FIG. 14B is the result of adjustment of the original image data of FIG. 14A performed according to the algorithm shown in FIGS. 12A to 12F. The data is converted into electric signals, as shown in FIG. 13, to be applied to the thermal head, thereby resulting in execution of collapse suppression control.

(Relationship with Electrification Table)

The thermal head is provided with the temperature sensor (thermistor). The thermistor measures ambient temperature (temperature increased due to the generation of heat mainly by the thermal head) at real time and sends the measurement result to the controller 2. The controller 2 refers to an electrification table that is a correspondence table indicating a correspondence relationship between temperatures and electrification times and sends a control signal to the driver IC 4*b* as the drive circuit for the thermal head 4. Based on the control signal, the driver IC 4*b* sends an electric signal to the thermal head. The ambient temperature of the thermal head varies at real time depending on operational statuses, such as continuation of high black dot ratio status. Thus, the controller 2 also frequently refers to the electrification table at real time.

The heating control according to the embodiment of the present invention is based on adjustment processing performed by calculation of a logical product using bit-shifting of bit data of each line just before and after a line to be printed. However, since the temperature change of the thermal head varies at real time, the adjustment processing according to the embodiment is also performed at real time.

(Judgment for Executing Adjustment Processing According to the Embodiment)

In addition, a judgment as to whether or not to use the control may be dynamically made during printing.

For example, when printing an Nth line, the number of dots to be heated in all of an N−1th line, the Nth line, and an N+1th line is counted, and only when the count value exceeds a predetermined value, the control is used. In other words, a black dot ratio is calculated at real time and in the case where the calculated black dot ratio exceeded the predetermined value, the adjustment processing according to the embodiment of the present invention is performed.

Alternatively, the control may be used when the number of dots to be heated in the Nth line is equal to or more than a predetermined value and a total number of dots to be heated in the three lines including the previous and next lines is equal to or more than a predetermined value (obviously, not only the previous and next lines but also the second previous and second next lines may be taken into consideration).

Furthermore, as a judgment parameter, thermistor detection temperature may be added.

In other words, the control may be used when the thermistor detection temperature is equal to or more than a predetermined value, the number of dots to be heated in the Nth line is equal to or more than a predetermined value, and the total number of dots to be heated in the three line including the previous and next lines is equal to or more than a predetermined value.

The reason why the black dot ratios of the neighboring lines are used as judgment parameters is that the thermistor for detecting a print head temperature cannot directly measure temperatures of the heating elements after all.

However, the most important factor in the collapse control is thermal accumulation in the heating elements themselves. Even if the thermistor detection temperature is low, when there is any region in which solid black portions (portions to be heated) sequentially continue, dots to be non-heated dotted in the region tend to be still collapsed.

This tendency is more apparent particularly when a print medium is not thermal paper or the like but a porous resin (more accurately, although even relatively minute dots allow reproduction of the image of a stamp face, excessively small dots hinder ink from oozing out when impressing a stamp. Accordingly, judging based on a seal pattern left by the stamp, the tendency is very noticeable).

However, when the thermistor can detect the temperatures of the heating elements with high precision, a judgment on the use of the control may be made only by thermistor detection temperature.

Advantageous Effects of the Present Embodiment

In the stamp face forming apparatus according to the first embodiment described hereinabove, reducing the amounts of heat for dots to be heated directly adjacent to a dot to be non-heated allows the suppression of dot collapse.

Second Embodiment

Figure 15A:
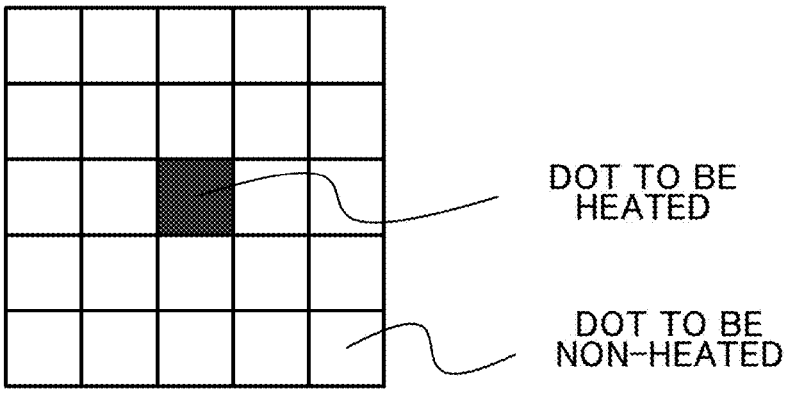
FIG. 15A is a diagram showing an example of an isolated dot to be heated.

As described above, the stamp face forming apparatus (printer 1) according to the first embodiment can form a stamp face in which the collapse of a dot has been suppressed by reducing the amount of heat for a dot to be heated directly adjacent to a dot to be non-heated. However, the stamp face forming apparatus of the first embodiment reduces the amount of heat for all of dots to be heated that are directly adjacent to a dot to be non-heated, regardless of the circumstances of the dots. Accordingly, for example, as shown in FIG. 15A, when the amount of heat for an isolated dot to be heated surrounded by dots to be non-heated is reduced, it can be difficult to obtain a sufficient amount of heat. As a result, there arise problems in that printing results tend to be collapsed due to ink, particularly in images in which many dots are those to be non-heated (portions in which ink oozes out), for example, such as error-diffused images.

Figure 15B:
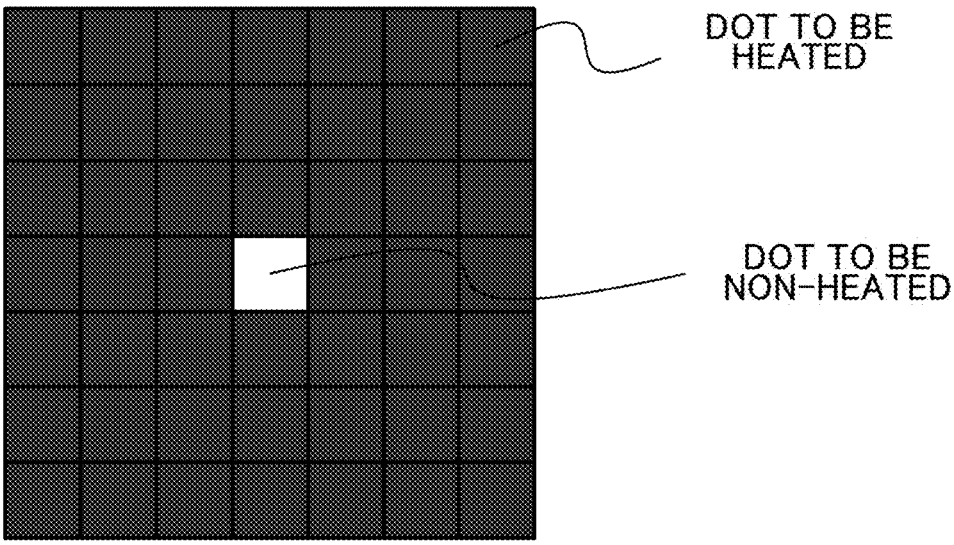
FIG. 15B is a diagram showing an example of an isolated dot to be non-heated.

Thus, considering that a dot most likely to be collapsed is a dot to be non-heated (an isolated dot) surrounded by dots to be heated on all sides, as shown in FIG. 15B, a stamp face forming apparatus according to a second embodiment of the present invention specifies such an isolated dot and reduces amounts of heat for only dots to be heated around the isolated dot. The stamp face forming apparatus according to the second embodiment achieves the above processing, without any complicated calculation, by repetition of bit operation with a light load on the CPU.

To perform the processing, the controller 2 in the stamp face forming apparatus of the second embodiment includes a specifier for specifying the dot to be non-heated (hereinafter referred to as "isolated dot") in which both dots on both adjacent sides of the isolated dot in a main scanning direction of image data for forming a stamp face are dots to be heated and both dots on both adjacent sides of the isolated dot in a sub-scanning direction thereof are dots to be heated. Then, the specifier creates adjustment data according to an algorithm different from the algorithm described in the first embodiment (FIGS. 12A to 12F). Outlines of other structures of the stamp face forming apparatus of the second embodiment, the structure of the stamp face material holder 20, and the like are the same as those described in the first embodiment with reference to the respective drawings. Thus, a detailed description of the apparatus will be omitted here.

The stamp face forming apparatus according to the second embodiment creates adjustment data according to the following steps 1 to 3:

(Step 1): the specifier creates data in which only dot(s) isolated in the main scanning direction are set to 0 in original data of a single line.

(Step 2): the specifier compares the created data with original data of lines previous and next to the single line and causes only the dot(s) isolated even in the sub-scanning direction out of the dot(s) set to 0 in the data created by the step 1 to be left as 0, thereby specifying the isolated dot(s).

(Step 3): the controller 2 reduces an amount of heat for each of dots to be heated directly adjacent to the isolated dot(s) specified by the step 2.

Figure 16:
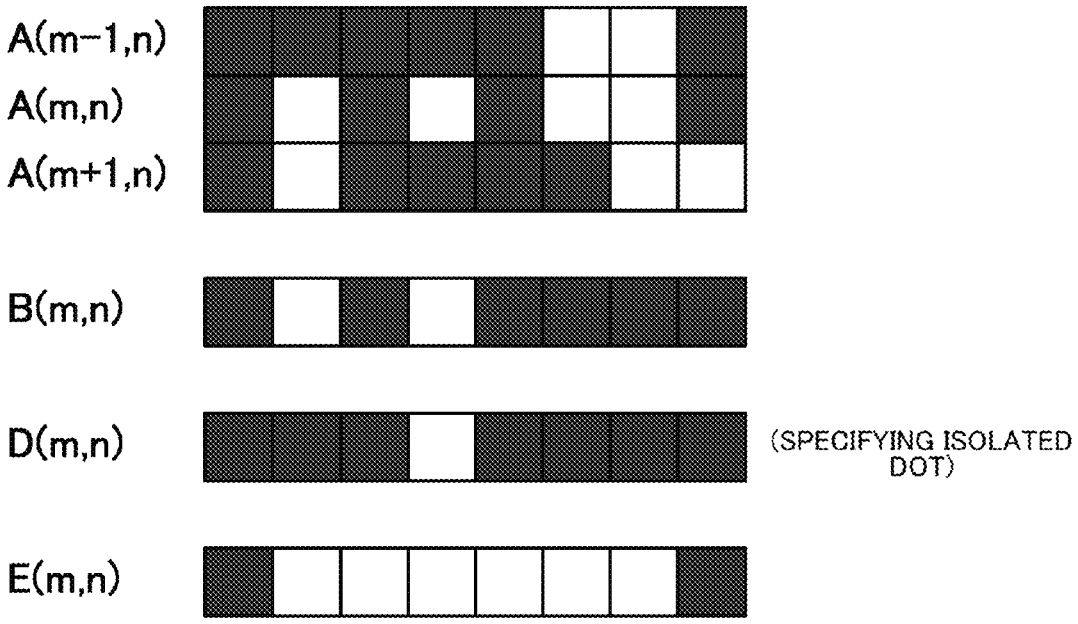
FIG. 16 is a diagram showing adjustment data creating method in a second embodiment.

A detailed description will be given of adjustment data creating method in the second embodiment. FIG. 16 is a diagram showing the adjustment data creating method in the second embodiment. In a specific bit calculation or the like, a dot to be heated is treated as 1 and a dot to be non-heated is treated as 0.

In a data matrix (original data) to be printed sent to the printer 1 from a client device, such as a PC 44, original data of an m-th row (namely, an m-th line) and an n-th byte is represented as A(m, n). Specifically, in the example of FIG. 16, the original data A (m, n) is a data stream including eight dots of "10101001" from a most significant bit (MSB) to a least significant bit (LSB).

The MSB of print data is transmitted first to the thermal head (stamp face forming part) 4. In other words, for example, an LSB of original data A(m, n−1) of an (n−1)th byte in the m-th line is transmitted to the thermal head 4 and then, the MSB of the original data A (m, n) of the n-th byte is transmitted to the thermal head 4.

First, the specifier develops the original data A (m, n) of a single line to be printed in the buffer of the RAM.

Next, the specifier creates data A' (m, n) in which dot(s) to be non-heated not isolated in the main scanning direction (namely, in a certain m-th line) in the original data A (m, n) of the single line, that is, only dot(s) to be non-heated other than dot(s) to be non-heated having dots to be heated on both adjacent sides thereof in the main scanning direction are set to 1, according to the following formula (1). Specifically, in the example of FIG. 16, when the original data A(m, n) is the data stream "10101001", the A' (m, n) is obtained as a data stream "00000110".

$$A'(m,n)=[\{(\neg A(m,n)>>1) \text{ OR } 0x80\} \text{ AND } \neg A(m,n)] \text{ OR } [\{(\neg A(m,n)<<1) \text{ OR } 0x01\} \text{ AND } \neg A(m,n)] \quad (1)$$

Herein, in the logical calculation, "AND" represents bitwise logical product; "OR" represents bitwise logical sum; "XOR" represents bitwise exclusive logical sum; "¬" represents bitwise bit inversion; ">>" represents bit shift to right; and "<<" represents bit shift to left. For example, an expression "¬ X>>1" represents that each bit of data X is inverted and then shifted to the right by 1 bit.

In addition, the formula (1) is an exemplification, and it is also possible to use another formula obtained by modifying the formula (1) using the De Moivre's theorem or the like. In other words, the controller 2 can use another algorithm as long as the algorithm allows an operation for setting only dot(s) to be non-heated not isolated in the main scanning direction to 1. The following calculation is also the same as above.

The specifier obtains an exclusive logical sum of the created data A'(m, n) and the original data A(m, n), and then, creates data B(m, n) in which only isolated dot(s) in the main scanning direction in the original data A(m, n) are set to 0, according to the following formula (2). Specifically, in the example of FIG. 16, the data B(m, n) is obtained as a data stream "10101111".

$$B(m,n)=\{A'(m,n)\ \text{XOR}\ A(m,n)\} \tag{2}$$

In the calculation of the B(m, n), the presence or absence of isolation has not been considered regarding an LSB and an MSB of the A(m, n), and the LSB and MSB of the B(m, n) are both definitely 1. In other words, in the calculation of the B(m, n), the LSB and MSB of the A(m, n) have been treated as non-isolated dots regardless of whether the dots are isolated or not.

The next consideration will be the LSB and the MSB of the A(m, n). A case in which the LSB of the A(m, n) is isolated corresponds to a case in which the LSB of the A(m, n) is 0 (a dot to be non-heated) and a second bit from the LSB of the A(m, n) and an MSB of an A(m, n+1) are both 1 (dots to be heated). Accordingly, when the following formulae (3-1) and (3-2) are both established, the LSB of the A(m, n) is found to be isolated in the main scanning direction.

$$\{A(m,n)\ \text{AND}\ 0x03\}=0x02 \tag{3-1}$$

$$\{A(m,n+1)\ \text{AND}\ 0x80\}=0x80 \tag{3-2}$$

Similarly, a case in which the MSB of the A(m, n) is isolated corresponds to a case in which the MSB of the A(m, n) is 0 (a dot to be non-heated) and a second bit from the MSB of the A(m, n) and an LSB of an A(m, n−1) are both 1 (dots to be heated). Accordingly, when the following formulae (4-1) and (4-2) are both established, the MSB of the A(m, n) is found to be isolated in the main scanning direction.

$$\{A(m,n)\ \text{AND}\ 0xC0\}=0x40 \tag{4-1}$$

$$\{A(m,n-1)\ \text{AND}\ 0x01\}=0x01 \tag{4-2}$$

As described above, the LSB and the MSB of the B(m, n) are definitely 1. Accordingly, when the LSB or the MSB of the A(m, n) is found to be isolated by the steps of the formulae (3-1) to (4-2), the specifier changes a bit found to be isolated of the LSB and the MSB of the B(m, n) to 0. The data thus obtained is represented as C(m, n).

In the example of FIG. 16, both of the LSB and the MSB of the original data A(m, n) are 1 (dots to be heated) and not isolated dots. Thus, the C(m, n) is equal to the B(m, n). Accordingly, the C(m, n) is omitted in FIG. 16.

Next, the specifier determines the presence or absence of isolation in the sub-scanning direction. For the determination, the specifier compares the C(m, n) in which only isolated dots in the main scanning direction are 0 with original data of lines that are previous and next to the C(m, n), that is, original data A(m−1, n) of an (m−1)th line and original data A(m+1, n) of an (m+1)th line. Then, according to the following formula (5), the specifier creates data D(m, n) in which, out of dot(s) set to 0 in the C(m, n), only isolated dot(s) even in the sub-scanning direction are left as 0 and the remaining dot(s) are set to 1.

$$D(m,n)=[\neg\{C(m,n)\ \text{OR}\ A(m-1,n)\}\ \text{XOR}\ C(m,n)]\ \text{OR}\ [\neg\{C(m,n)\ \text{OR}\ A(m+1,n)\}\text{XOR}\ C(m,n)] \tag{5}$$

Specifically, in the example of FIG. 16, a second bit and a fourth bit of the original data A(m−1, n) in the (m−1)th line are dots to be heated, and a second bit of the original data A(m+1, n) in the (m+1)th line is a dot to be non-heated and a fourth bit of the original data A(m+1, n) therein is a dot to be heated. In other words, the dot to be non-heated at the second bit of the original data A(m, n) is not isolated in the sub-scanning direction and only the dot to be non-heated at the fourth bit is isolated in the sub-scanning direction. Thus, when the C(m, n) is represented by the data stream "10101111", the D(m, n) is obtained as a data stream "11101111" in which only the fourth bit is 0.

The bit set to 0 in the data D(m, n) thus obtained is a dot to be non-heated having dots to be heated on both adjacent sides thereof in both of the main scanning direction and the sub-scanning direction (an isolated dot). It is highly likely that such an isolated dot to be non-heated is collapsed by heat accumulated in the surrounding dots to be heated. The controller 2 therefore causes an amount of heat per dot for the dots to be heated directly adjacent to the isolated dot to be less than an amount of heat per dot for dot(s) to be heated other than the dots to be heated directly adjacent to the isolated dot, thereby suppressing collapse of the isolated dot due to the accumulated heat.

The method for reducing the amount of the heat is the same as that described in the first embodiment. In other words, the controller 2 creates temporary adjustment data from the data D(m, n) in which the isolated dot has been specified and the original data A(m, n), and then creates first adjustment data and last adjustment data from the data D(m−1, n) and the data D(m+1, n) in which an isolated dot has been specified in lines previous and next to the line of the data D(m, n).

Specifically, according to the following formula (6), the controller 2 obtains a logical product of 1-bit left-shifted data of the D(m, n) and the D(m, n) and a logical product of 1-bit right-shifted data of the D(m, n) and the D(m, n), respectively, and then, obtains a logical product of data of a logical product of the obtained two expressions and the original data A(m, n). As a result, there can be obtained temporary adjustment data E(m, n) in which dots on both adjacent sides of the isolated dot are 0 in the original data A(m, n). Specifically in the example of FIG. 16, the temporary adjustment data E(m, n) is obtained as a data sequence "10000001". For easier understanding, a description of an LSB and an MSB will be omitted.

$$E(m,n)=[\{D(m,n)\ \text{AND}\ (D(m,n)>>1)\}\ \text{AND}\ \{D(m,n)\ \text{AND}\ (D(m,n)<<1)\}]\ \text{AND}\ A(m,n) \tag{6}$$

The controller 2 repeats such processing for creating the temporary adjustment data E(m, n), regarding arbitrary m and n. Then, the controller 2 creates first adjustment data by obtaining a logical product of the obtained temporary adjustment data E(m, n) and the data D(m−1, n) of the previous line in which an isolated dot has been specified, and creates last adjustment data by obtaining a logical product of the temporary adjustment data E(m, n) and data D(m+1, n) of the next line in which an isolated dot has been specified. Then, the controller 2 controls the amounts of heat for the dots around the isolated dots by a pulse ratio of the original data A(m, n) and the adjustment data (the first adjustment data and the last adjustment data).

In other words, the controller 2 uses the first adjustment data as the above-described first adjustment pulse data and the last adjustment data as the above-described last adjustment pulse data in the electric signals having the structure shown in FIG. 13, thereby causing an amount of heat per dot for dots directly adjacent to an isolated dot to be non-heated to be less than an amount of heat per dot for dot(s) to be heated other than the dots to be heated directly adjacent to the isolated dot. As a result, collapse of the isolated dot to be non-heated can be suppressed.

The stamp face forming apparatus of the second embodiment described above specifies an isolated dot to be non-heated so as to limit dots to be heated for which the amount of heat is to be reduced to dots to be heated directly adjacent to the isolated dot to be non-heated. In this way, the apparatus can form a high-quality stamp face in which the collapse of an isolated dot to be non-heated is suppressed, while preventing a stamped seal pattern from being collapsed by ink due to excessive reduction in the amounts of heat for dots to be heated.

Modified Examples

While embodiments of the present invention have been described above, the embodiments are merely examples and should not be construed to narrow the scope of the present invention. In other words, the embodiments of the present invention can be applied in various forms, and these and other embodiments are included in the scope of the present invention.

For example, in the second embodiment described above, the specifier has specified a dot to be non-heated having dots to be heated on both adjacent sides thereof in both of the main scanning direction and the sub-scanning direction in image data for forming a stamp face, and the controller has reduced the amounts of heat for the four adjacent dots to be heated. However, in the present invention, the specifier may specify a dot to be non-heated having dots to be heated on both adjacent sides thereof in only one of the main scanning direction and the sub-scanning direction, and the controller may reduce the amounts of heat for the dots to be heated on both adjacent sides of the specified dot to be non-heated.

For example, data that specifies a dot to be non-heated having dots to be heated on both adjacent sides thereof only in the main scanning direction corresponds to the above-described C(m, n). Thus, it is enough to create temporary adjustment data from the C(m, n) and the original data A(m, n), without the step of calculating the D(m, n) from the C(m, n). Similarly, in the method for specifying a dot to be non-heated having dots to be heated on both adjacent sides thereof only in the sub-scanning direction, the same processing can be performed by switching the main scanning direction and the sub-scanning direction. In this manner, use of the simpler algorithm than that shown in the second embodiment allows the prevention of collapse of a stamped seal pattern by ink due to excessive reduction in the amounts of heat for dots to be heated.

The present invention can provide a stamp face forming apparatus that includes the structure for achieving the functions according to the invention in advance, as well as allows an existing information processing apparatus or the like to function as the stamp face forming apparatus according to the embodiments of the present invention by application of a program. In other words, the existing information processing apparatus or the like can be caused to function as the stamp face forming apparatus of the embodiments of the present invention by applying a program for achieving the respective functional configurations by the stamp face forming apparatus 1 exemplified in the above embodiments in such a manner that the CPU or the like for controlling the existing information processing apparatus or the like can execute the program. Additionally, a stamp face forming method according to an embodiment of the present invention can be performed using the stamp face forming apparatus of the embodiments thereof.

In addition, the method for applying such a program is an arbitrary one. For example, the program can be applied by storing in a computer readable recording medium such as a flexible disc, CD (Compact Disc)-ROM, DVD (Digital Versatile Disc)-ROM, or memory card. Furthermore, the program can be applied through a communication medium such as the Internet by superimposing the program on a carrier wave. In addition, for example, the program may be put on a bulletin board system on a communication network (BBS), from which the program may be delivered. Then, the program may be started and executed similarly to other application programs under control of an operation system (OS) to execute the above processing.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A stamp face forming apparatus comprising:

a stamp face forming part comprising a plurality of heating elements arranged in a direction along a surface holding a porous stamp face material that can be made non-porous by heating, and a drive circuit for controlling heat generating states of the plurality of heating elements so as to form a stamp face on the stamp face material; and a controller for controlling the drive circuit of the stamp face forming part by adjusting a signal to be applied to the drive circuit such that an amount of heat per dot for a dot to be heated which is directly adjacent to a dot to be non-heated is less than an amount of heat per dot for a dot to be heated which is not directly adjacent to the dot to be non-heated in image data for forming the stamp face, wherein:

the signal for controlling the plurality of heating elements applied to the drive circuit is a multi-pulse signal, the controller is configured to:

create first dot data based on a result of logical calculation between (i) dots of dot data obtained by shifting dot data of an Nth line of the image data by +1 in a main scanning direction and (ii) dots of dot data obtained by shifting the dot data of the Nth line by −1 in the main scanning direction;

create second dot data by logical calculation between dots of an N−1th line of the image data and dots of the first dot data;

create third dot data by logical calculation between dots of an N+1th line of the image data and the dots of the first dot data;

create an adjusted signal based on the second dot data, the third dot data, and the dot data of the Nth line; and apply, to the drive circuit, the adjusted signal that controls the multi-pulse signal for each pulse;

the drive circuit is configured to reduce an amount of heat per dot for a dot to be heated which is adjacent to a dot to be non-heated of the Nth line, to be less than an amount of heat per dot for a dot to be heated which is not adjacent to the dot to be non-heated of the Nth line by heating the dot of the Nth line in accordance with the adjusted signal;

the N−1th line and the Nth line are positioned next to each other in a sub-scanning direction which is perpendicular to the main scanning direction; and the Nth line and the N+1th line are positioned next to each other in the sub-scanning direction.

2. The stamp face forming apparatus according to claim 1, wherein the controller executes control of the amount of heat per dot for the dot to be heated which is directly adjacent to the dot to be non-heated when a black dot ratio as a ratio of dots to be heated based on dot data of each line of the image data, dot data per previous line or next line with respect to said each line, or a combination of the dot data is equal to or more than a predetermined value.

3. The stamp face forming apparatus according to claim 1, wherein:

the stamp face forming part comprises a temperature sensor for detecting a temperature around the stamp face forming part, and the controller executes control of the amount of heat per dot for the dot to be heated which is directly adjacent to the dot to be non-heated when the temperature detected by the temperature sensor is equal to or more than a predetermined temperature.

4. The stamp face forming apparatus according to claim 1, wherein:

the controller comprises a specifier for specifying, among dots to be non-heated, a dot to be non-heated having dots to be heated on both directly adjacent sides thereof in at least one of the main scanning direction and the sub-scanning direction, and the controller controls the drive circuit by adjusting the signal such that an amount of heat per dot for the dots to be heated on both directly adjacent sides of the dot to be non-heated specified by the specifier in the image data is less than an amount of heat per dot for a dot to be heated other than the dots to be heated on both directly adjacent sides of the dot to be non-heated.

5. The stamp face forming apparatus according to claim 4, wherein:

the specifier specifies, among the dots to be non-heated, a dot to be non-heated having dots to be heated on both directly adjacent sides thereof in the main scanning direction and having dots to be heated on both directly adjacent sides thereof in the sub-scanning direction, and the controller controls the drive circuit by adjusting the signal such that an amount of heat per dot for the four dots to be heated directly adjacent to the dot to be non-heated specified by the specifier is less than an amount of heat per dot for a dot to be heated other than the four dots to be heated directly adjacent to the dot to be non-heated.

6. The stamp face forming apparatus according to claim 1, wherein the stamp face forming part does not cause a heating element of the plurality of heating elements at a position corresponding to the dot to be non-heated to generate heat and causes a heating element of the plurality of heating elements at a position corresponding to the dot to be heated to generate heat.

7. The stamp face forming apparatus according to claim 1, wherein the drive circuit divides the plurality of heating elements into a plurality of blocks and drives the plurality of heating elements per block.

8. The stamp face forming apparatus according to claim 1, wherein a number of pulses of the signal are respectively adjusted to correspond to a specified number of pulses in accordance with a number of pulses of the multi-pulse signal based on the second dot data, the dot data of the Nth line, and the third dot data.

9. A stamp face forming method for a stamp face forming apparatus which includes a stamp face forming part comprising a plurality of heating elements arranged in a direction along a surface holding a porous stamp face material that can be made non-porous by heating, and a drive circuit for controlling heat generating states of the plurality of heating elements so as to form a stamp face on the stamp face material, the method comprising:

forming the stamp face by controlling the drive circuit by adjusting a signal to be applied to the drive circuit such that an amount of heat per dot for a dot to be heated which is directly adjacent to a dot to be non-heated is less than an amount of heat per dot for a dot to be heated which is not directly adjacent to the dot to be non-heated in image data for forming the stamp face, when forming the stamp face on the stamp face material while relatively moving the stamp face material with respect to the stamp face forming part, wherein:

the signal for controlling the plurality of heating elements applied to the drive circuit is a multi-pulse signal, said controlling comprises:

creating first dot data based on a result of logical calculation between (i) dots of dot data obtained by shifting dot data of an Nth line of the image data by +1 in a main scanning direction and (ii) dots of dot data obtained by shifting the dot data of the Nth line by −1 in the main scanning direction;

creating second dot data by logical calculation between dots of an N−1th line of the image data and dots of the first dot data;

creating third dot data by logical calculation between dots of an N+1th line of the image data and the dots of the first dot data;

creating an adjusted signal based on the second dot data, the third dot data, and the dot data of the Nth line; and applying, to the drive circuit, the adjusted signal that controls the multi-pulse signal for each pulse;

the drive circuit is controlled to reduce an amount of heat per dot for a dot to be heated which is adjacent to a dot to be non-heated of the Nth line, to be less than an amount of heat per dot for a dot to be heated which is not adjacent to the dot to be non-heated of the Nth line by heating the dot of the Nth line, in accordance with the adjusted signal;

the N−1th line and the Nth line are positioned next to each other in a sub-scanning direction which is perpendicular to the main scanning direction; and the Nth line and the N+1th line are positioned next to each other in the sub-scanning direction.

10. The stamp face forming method according to claim 9, wherein the control of the amount of heat per dot for the dot to be heated which is directly adjacent to the dot to be non-heated is executed when a black dot ratio as a ratio of dots to be heated based on dot data of each line in formation of the stamp face, dot data per previous line or next line with respect to said each line, or a combination of the dot data is equal to or more than a predetermined value.

11. The stamp face forming method according to claim 9, wherein the control of the amount of heat per dot for the dot to be heated which is directly adjacent to the dot to be non-heated is executed when a temperature detected by a temperature sensor provided in the stamp face forming part in order to detect a temperature around the stamp face forming part is equal to or more than a predetermined temperature.

12. The stamp face forming method according to claim 9, wherein:

forming the stamp face comprises specifying, among dots to be non-heated, a dot to be non-heated having dots to be heated on both directly adjacent sides thereof in at least one of the main scanning direction and the sub-scanning direction, and when forming the stamp face on the stamp face material, the drive circuit is controlled by adjusting the signal such that an amount of heat per dot for the dots to be heated on both directly adjacent sides of the specified dot to be non-heated is less than an amount of heat per dot for a dot to be heated other than the dots to be heated on both directly adjacent sides of the dot to be non-heated.

13. The stamp face forming method according to claim 12, wherein:

the specifying comprises specifying, among the dots to be non-heated, a dot to be non-heated having dots to be heated on both directly adjacent sides thereof in the main scanning direction and having dots to be heated on both directly adjacent sides thereof in the sub-scanning direction, and when forming the stamp face on the stamp face material, the drive circuit is controlled by adjusting the signal such that an amount of heat per dot for the four dots to be heated directly adjacent to the specified dot to be non-heated is less than an amount of heat per dot for a dot to be heated other than the four dots to be heated directly adjacent to the dot to be non-heated.

14. The stamp face forming method according to claim 9, wherein the drive circuit divides the plurality of heating elements into a plurality of blocks and drives the plurality of heating elements per block.

15. The stamp face forming method according to claim 9, wherein a number of pulses of the signal are respectively adjusted to correspond to a specified number of pulses in accordance with a number of pulses of the multi-pulse signal based on the second dot data, the dot data of the Nth line, and the third dot data.

16. A non-transitory computer-readable recording medium having stored thereon computer-executable instructions that are executable by a computer of a stamp face forming apparatus which includes a stamp face forming part comprising a plurality of heating elements arranged in a direction along a surface holding a porous stamp face material that can be made non-porous by heating, and a drive circuit for controlling heat generating states of the plurality of heating elements so as to form a stamp face on the stamp face material, the instructions being executable by the computer to cause the computer to perform functions comprising:

controlling the drive circuit by adjusting a signal to be applied to the drive circuit such that an amount of heat per dot for a dot to be heated which is directly adjacent to a dot to be non-heated is less than an amount of heat per dot for a dot to be heated which is not directly adjacent to the dot to be non-heated in image data for forming the stamp face, when forming the stamp face on the stamp face material while relatively moving the stamp face material with respect to the stamp face forming part, wherein:

the signal for controlling the plurality of heating elements applied to the drive circuit is a multi-pulse signal, said controlling comprises:

creating first dot data based on a result of logical calculation between (i) dots of dot data obtained by shifting dot data of an Nth line of the image data by +1 in a main scanning direction and (ii) dots of dot data obtained by shifting the dot data of the Nth line by −1 in the main scanning direction;

creating second dot data by logical calculation between dots of an N−1th line of the image data and dots of the first dot data;

creating third dot data by logical calculation between dots of an N+1th line of the image data and the dots of the first dot data;

creating an adjusted signal based on the second dot data, the third dot data, and the dot data of the Nth line; and applying, to the drive circuit, the adjusted signal that controls the multi-pulse signal for each pulse;

the drive circuit is controlled to reduce an amount of heat per dot for a dot to be heated which is adjacent to a dot to be non-heated of the Nth line, to be less than an amount of heat per dot for a dot to be heated which is not adjacent to the dot to be non-heated of the Nth line by heating the dot of the Nth line, in accordance with the adjusted signal;

the N−1th line and the Nth line are positioned next to each other in a sub-scanning direction which is perpendicular to the main scanning direction; and the Nth line and the N+1th line are positioned next to each other in the sub-scanning direction.

17. The medium according to claim 16, wherein the instructions cause the computer to execute the control of the amount of heat per dot for the dot to be heated which is directly adjacent to the dot to be non-heated when a black dot ratio as a ratio of dots to be heated based on dot data of each line in formation of the stamp face, dot data per previous line or next line with respect to said each line, or a combination of the dot data is equal to or more than a predetermined value.

18. The medium according to claim 16, wherein the instructions cause the computer to execute the control of the amount of heat per dot for the dot to be heated which is directly adjacent to the dot to be non-heated when a temperature detected by a temperature sensor provided in the stamp face forming part in order to detect a temperature around the stamp face forming part is equal to or more than a predetermined temperature.

19. The medium according to claim 16, wherein:

the instructions cause the computer to specify, among dots to be non-heated, a dot to be non-heated having dots to be heated on both directly adjacent sides thereof in at least one of the main scanning direction and the sub-scanning direction, and when forming the stamp face on the stamp face material, the instructions cause the computer to control the drive circuit by adjusting the signal such that an amount of heat per dot for the dots to be heated on both directly adjacent sides of the dot to be non-heated specified by computer is less than an amount of heat per dot for a dot to be heated other than the dots to be heated on both directly adjacent sides of the dot to be non-heated.

20. The medium according to claim 16, wherein:

the instructions cause the computer to specify, among the dots to be non-heated, a dot to be non-heated having dots to be heated on both directly adjacent sides thereof in the main scanning direction and having dots to be heated on both directly adjacent sides thereof in the sub-scanning direction; and when forming the stamp face on the stamp face material, the instructions cause the computer to control the drive circuit by adjusting the signal such that an amount of heat per dot for the four dots to be heated directly adjacent to the dot to be non-heated specified by the computer is less than an amount of heat per dot for a dot to be heated other than the four dots to be heated directly adjacent to the dot to be non-heated.

21. The medium according to claim 16, wherein the drive circuit divides the plurality of heating elements into a plurality of blocks and drives the plurality of heating elements per block.

22. The medium according to claim 16, wherein a number of pulses of the signal are respectively adjusted to correspond to a specified number of pulses in accordance with a number of pulses of the multi-pulse signal based on the second dot data, the dot data of the Nth line, and the third dot data.

* * * * *